US011133019B2

(12) United States Patent
Braun et al.

(10) Patent No.: US 11,133,019 B2
(45) Date of Patent: Sep. 28, 2021

(54) SIGNAL PROCESSOR AND METHOD FOR PROVIDING A PROCESSED AUDIO SIGNAL REDUCING NOISE AND REVERBERATION

(71) Applicant: Fraunhofer-Gesellschaft zur Förderung der angewandten Forschung e.V., Munich (DE)

(72) Inventors: Sebastian Braun, Eichstätt (DE); Emanuel Habets, Spardorf (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 16/824,421

(22) Filed: Mar. 19, 2020

(65) Prior Publication Data

US 2020/0219524 A1 Jul. 9, 2020

Related U.S. Application Data

(63) Continuation of application No. PCT/EP2018/075529, filed on Sep. 20, 2018.

(30) Foreign Application Priority Data

Sep. 21, 2017 (EP) ..... 17192396
Feb. 23, 2018 (EP) ..... 18158479

(51) Int. Cl.
*G10L 21/0232* (2013.01)
*G10L 21/0264* (2013.01)
*G10L 21/0208* (2013.01)

(52) U.S. Cl.
CPC ..... *G10L 21/0232* (2013.01); *G10L 21/0264* (2013.01); *G10L 2021/02082* (2013.01)

(58) Field of Classification Search
None
See application file for complete search history.

(56) References Cited

U.S. PATENT DOCUMENTS 6,324,502 B1 11/2001 Handel et al.
8,290,170 B2 10/2012 Nakatani et al.
(Continued)

FOREIGN PATENT DOCUMENTS

JP 2000504434 A 4/2000
RU 2545384 C2 3/2015
WO 2009110574 A1 9/2009

OTHER PUBLICATIONS

R. E. Kalman: "A new approach to linear filtering and prediction problems," Trans. of the ASME Journal of Basic Engineering, vol. 82, No. Series D, pp. 35-45., 1960.
(Continued)

*Primary Examiner* — Walter F Briney, III
(74) *Attorney, Agent, or Firm* — Michael A. Glenn; Perkins Coie LLP

(57) ABSTRACT

A signal processor for providing one or more processed audio signals on the basis of one or more input audio signals is configured to estimate coefficients of an autoregressive reverberation model using the input audio signals and the delayed noise-reduced reverberant signals obtained using a noise reduction. The signal processor is configured to provide noise-reduced reverberant signals using the input audio signals and the estimated coefficients of the autoregressive reverberation model. The signal processor is configured to derive noise-reduced and reverberation-reduced output signals using the noise-reduced reverberant signals and the estimated coefficients of the autoregressive reverberation model. A method and a computer program include a similar functionality.

26 Claims, 16 Drawing Sheets

(56) References Cited

U.S. PATENT DOCUMENTS

| | | | | |
|---|---|---|---|---|
| 8,467,538 | B2 | 6/2013 | Nakatani et al. | |
| 8,848,933 | B2 | 9/2014 | Yoshioka et al. | |
| 9,288,576 | B2 | 3/2016 | Togami et al. | |
| 2011/0044462 | A1* | 2/2011 | Yoshioka | 381/66 |
| 2011/0249826 | A1 | 10/2011 | Van | |
| 2012/0148056 | A1 | 6/2012 | Pedersen | |

OTHER PUBLICATIONS

E. B. Union. (1988) Sound quality assessment material recordings for subjective tests. [Online]. Available: http://tech.ebu.ch/publications/sqamcd, 1988.

N. Kitawaki et al: "Objective quality evaluation for low bit-rate speech coding systems," IEEE J. Sel. Areas Commun., vol. 6, No. 2, pp. 262-273., 1988.

G. Enzner et al.: "Frequency-domain adaptive Kalman filter for acoustic echo control in hands-free telephones," Signal Processing, vol. 86, No. 6, pp. 1140-1156, 2006.

T. Nakatani et al: "Speech dereverberation based on variance-normalized delayed linear prediction," IEEE Trans. Audio, Speech, Lang. Process., vol. 18, No. 7, pp. 1717-1731., 2010.

B. Schwartz et al: "Online speech dereverberation using Kalman filter and EM algorithm," IEEE Trans. Audio, Speech, Lang. Process., vol. 23, No. 2, pp. 394-406, 2015, 2015.

S. Braun et al: "A multichannel diffuse power estimator for dereverberation in the presence of multiple sources," EURASIP Journal on Audio, Speech, and Music Processing, pp. 1-14., 2015.

Online Available: http://www.audiolabs-erlangen.de/fau/professor/habets/software/signal-generator; retrieved from the Internet Aug. 20, 2020., 2020.

J. B. Allen et al.: "Image method for efficiently simulating small-room acoustics," J. Acoust. Soc. Am., vol. 65, No. 4, pp. 943-950., Apr. 1979.

D. Schmid et al.: "Variational Bayesian inference for multichannel dereverberation and noise reduction," IEEE Trans. Audio, Speech, Lang. Process., vol. 22, No. 8, pp. 1320-1335., Aug. 2014.

Y. Ephraim et al.: "Speech enhancement using a minimum-mean square error short-time spectral amplitude estimator," IEEE Trans. Acoust., Speech, Signal Process., vol. 32, No. 6, pp. 1109-1121., Dec. 1984.

T. Yoshioka et al.: "Generalization of multi-channel linear prediction methods for blind MIMO impulse response shortening," IEEE Trans. Audio, Speech, Lang. Process., vol. 20, No. 10, pp. 2707-2720., Dec. 2012.

S. Braun et al.: "Online dereverberation for dynamic scenarios using a Kalman filter with an autoregressive model," IEEE Signal Process. Lett., vol. 23, No. 12, pp. 1741-1745., Dec. 2016.

T. Yoshioka et al.: "Integrated speech enhancement method using noise suppression and dereverberation," IEEE Trans. Audio, Speech, Lang. Process., vol. 17, No. 2, pp. 231-246., Feb. 2009.

M. Miyoshi et al.: "Inverse filtering of room acoustics," IEEE Trans. Acoust., Speech, Signal Process., vol. 36, No. 2, pp. 145-152., Feb. 1988.

ITU-T, Perceptual evaluation of speech quality (PESQ), an objective method for end-to-end speech quality assessment of narrow-band telephone networks and speech codecs, International Telecommunications Union (ITU-T) Recommendation P.862., Feb. 2001.

O. Schwartz et al: "Multi-microphone speech dereverberation and noise reduction using relative early transfer functions," IEEE Trans. Audio, Speech, Lang. Process., vol. 23, No. 2, pp. 240-251, Jan. 2015.

K. Kinoshita et al: "A summary of the REVERB challenge: state-of-the-art and remaining challenges in reverberant speech processing research," EURASIP Journal on Advances in Signal Processing, vol. 2016, No. 1, p. 7., Jan. 2016.

A. Jukic et al.: "Adaptive speech dereverberation using constrained sparse multichannel linear prediction," IEEE Signal Process. Lett, vol. 24, No. 1, pp. 101-105., Jan. 2017.

S. Gannot et al.: "Iterative and sequential Kalman filter-based speech enhancement algorithms," IEEE Trans. Speech Audio Process., vol. 6, No. 4, pp. 373-385., Jul. 1998.

R. Martin: "Noise power spectral density estimation based on optimal smoothing and minimum statistics," IEEE Trans. Speech Audio Process., vol. 9, pp. 504-512., Jul. 2001.

M. Togami et al.: "Optimized speech dereverberation from probabilistic perspective for time varying acoustic transfer function," IEEE Trans. Audio, Speech, Lang. Process., vol. 21, No. 7, pp. 1369-1380., Jul. 2013.

T. Gerkmann et al.: "Unbiased MMSE-based noise power estimation with low complexity and low tracking delay," IEEE Trans. Audio, Speech, Lang. Process., vol. 20, No. 4, pp. 1383-1393., May 2012.

U. Niesen etal.: "Adaptive alternating minimization algorithms," IEEE Transactions on Information Theory, vol. 55, No. 3, pp. 1423-1429., Mar. 2009.

M. Togami et al.: "Noise robust speech dereverberation with Kalman smoother," in Proc. IEEE Intl. Cont on Acoustics, Speech and Signal Processing (ICASSP), pp. 7447-7451., May 2013.

T. Yoshioka et al.: "Making machines understand us in reverberant rooms: Robustness against reverberation for automatic speech recognition," IEEE Signal Processing Magazine, vol. 29, No. 6, pp. 114-126., Nov. 2012.

J. F. Santos et al.: "An updated objective intelligibility estimation metric for normal hearing listeners under noise and reverberation," in Proc. Intl. Workshop Acoust. Signal Enhancement (IWAENC), Antibes, France., Sep. 2014.

S. Goetze et al: "A study on speech quality and speech intelligibility measures for quality assessment of single-channel dereverberation algorithms," in Proc. Intl. Workshop Acoust. Signal Enhancement (IWAENC), pp. 233-237, Sep. 2014.

M. Taseska et al.: "MMSE-based blind source extraction in diffuse noise fields using a complex coherence-based a priori SAP estimator," in Proc. Intl. Workshop Acoust. Signal Enhancement (IWAENC), Aachen, Germany., Sep. 2012.

T. Yoshioka et al.: "Dereverberation for reverberation-robust microphone arrays," in Proc. European Signal Processing Conf. (EUSIPCO), pp. 1-5., Sep. 2013.

M. Togami: "Multichannel online speech dereverberation under noisy environments," in Proc. European Signal Processing Conf. (EUSIPCO), Nice, France, pp. 1078-1082., Sep. 2015.

A. Jukic et al.: "Constrained multi-channel linear prediction for adaptive speech dereverberation," in Proc. Intl. Workshop Acoust. Signal Enhancement (IWAENC), Xi'an, China., Sep. 2016.

T. Dietzen et al: "Partitioned block frequency domain Kalman filter for multi-channel linear prediction based blind speech dereverberation," in Proc. Intl. Workshop Acoust. Signal Enhancement (IWAENC), Xi'an, China, Sep. 2016.

"Consistent estimation of autoregressive parameters from noisy observations based on two interacting Kalman filters", D. Labarre et al.:Signal Processing, vol. 86, No. 10, pp. 2863-2876, 2006, special Section: Fractional Calculus Applications in Signals and Systems, 2006.

"Multi-step linear prediction based speech dereverberation in noisy reverberant environment", K. Kinoshita et al, Interspeech 2007, Aug. 27, 2007, pp. 854-857, XP055484719, Retrieved from the Internet: URL:http://www.isca-speech.org/archive/archive papers/interspeech 2007/i07 0854, Aug. 2007.

* cited by examiner

Generative model of the reverberant signal, multichannel autoregressive coefficients and noisy observation.

Proposed parallel dual Kalman filter structure.
The three-step procedure ensures that all blocks receive current parameter estimates without delay at each time step n.
For the grey noise estimation block, there exist several suitable solutions, which are beyond the scope of this application.

Conventional sequential noise reduction and dereverberation structure [31]. As the noise reduction receives delayed AR coefficients, they have to be assumed stationary or slowly time-varying Proposed structure to control the amount of noise reduction $\beta_v$ and reverberation reduction $\beta_r$.

Objective measures for varying microphone number using measured RIRs.

iSNR = 10 dB, L = 15, no reduction control ($\beta_v = \beta_r = 0$).

Objective measures for varying filter length L.
Parameters: iSNR = 15 dB, M = 2, no reduction control ($\beta_v = \beta_r = 0$).

Short-term measures for a moving source between 8-13 s in a simulated shoebox room with $T_{60}$ = 500 ms.

iSNR = 15 dB, M = 2, L = 15, $\beta_v$ = -10 dB, $\beta_{r,\,min}$ = -15 dB.

Noise reduction and reverberation reduction for varying control parameters $\beta_v$ and $\beta_{r,min}$, iSNR = 15 dB, M = 2, L = 12.

TABLE I objective measures for varying iSNRs (stationary noise) using measured RIRs.

$M = 2, L = 12, \beta_v = -10$ dB, $\beta_{r,\min} = -15$ dB

| iSNR [dB] | 0 | 5 | 15 | 25 | 35 |
|---|---|---|---|---|---|
| | | | ΔCD | | |
| single-Kalman [3] | -0.03 | 0.04 | 0.39 | 0.76 | 1.01 |
| MAP-EM [31] | 0.10 | 0.20 | 0.34 | 0.07 | -1.31 |
| dual-Kalman | 0.00 | 0.02 | 0.41 | 0.83 | 1.02 |
| dual-Kalman RC | **0.42** | **0.56** | **0.77** | **0.96** | **1.04** |
| | | | ΔPESQ | | |
| single-Kalman [3] | 0.05 | 0.12 | 0.20 | 0.33 | 0.40 |
| MAP-EM [31] | 0.15 | 0.21 | 0.20 | 0.24 | 0.25 |
| dual-Kalman | **0.54** | **0.53** | **0.47** | **0.51** | **0.50** |
| dual-Kalman RC | 0.34 | 0.40 | 0.34 | 0.39 | 0.40 |
| | | | ΔfwSSIR [dB] | | |
| single-Kalman [3] | 0.63 | 1.13 | 2.78 | 4.35 | 5.48 |
| MAP-EM [31] | 1.52 | 2.32 | 3.31 | 3.75 | 3.73 |
| dual-Kalman | **6.70** | **6.62** | **5.65** | **5.79** | **6.20** |
| dual-Kalman RC | 2.85 | 3.95 | 4.56 | 5.02 | 5.30 |
| | | | ΔSRMR | | |
| single-Kalman [3] | 0.21 | 0.29 | 0.38 | 0.42 | 0.44 |
| MAP-EM [31] | 0.46 | 0.44 | 0.31 | 0.28 | 0.27 |
| dual-Kalman | **1.37** | **0.98** | **0.58** | **0.50** | **0.47** |
| dual-Kalman RC | 0.89 | 0.75 | 0.47 | 0.45 | 0.41 |

Fig. 15
(Table 1)

TABLE II objective measures for varying iSNRs (babble noise) using measured RIRs.

$M = 2, L = 12, \beta_v = -10$ dB, $\beta_{r,\min} = -15$ dB

| iSNR [dB] | 0 | 5 | 15 | 25 | 35 |
|---|---|---|---|---|---|
| | | | ΔCD | | |
| single-Kalman [3] | -0.04 | 0.08 | 0.45 | 0.78 | 0.96 |
| MAP-EM [31] | -0.18 | -0.01 | 0.38 | 0.41 | -1.01 |
| dual-Kalman | -1.61 | -1.20 | -0.26 | 0.56 | **0.94** |
| dual-Kalman RC | **-0.03** | **0.10** | **0.49** | **0.79** | **0.94** |
| | | | ΔPESQ | | |
| single-Kalman [3] | 0.03 | 0.16 | 0.21 | 0.29 | 0.37 |
| MAP-EM [31] | -0.04 | 0.05 | 0.19 | 0.23 | 0.24 |
| dual-Kalman | -0.13 | 0.14 | **0.31** | **0.43** | **0.46** |
| dual-Kalman RC | **-0.18** | **0.20** | 0.28 | 0.34 | 0.37 |
| | | | ΔfwSSIR [dB] | | |
| single-Kalman [3] | 0.71 | 1.35 | 3.01 | 4.41 | 5.29 |
| MAP-EM [31] | 1.10 | 1.93 | 3.36 | 3.83 | 3.36 |
| dual-Kalman | **3.45** | **4.04** | **4.34** | **5.06** | **5.83** |
| dual-Kalman RC | 2.03 | 3.03 | 3.95 | 4.55 | 5.03 |
| | | | ΔSRMR | | |
| single-Kalman [3] | 0.22 | 0.31 | 0.39 | 0.40 | 0.42 |
| MAP-EM [31] | 0.30 | 0.38 | 0.32 | 0.27 | 0.25 |
| dual-Kalman | **1.21** | **1.08** | **0.55** | **0.45** | **0.46** |
| dual-Kalman RC | 0.72 | 0.77 | 0.48 | 0.41 | 0.41 |

Fig. 16
(Table 2)

SIGNAL PROCESSOR AND METHOD FOR PROVIDING A PROCESSED AUDIO SIGNAL REDUCING NOISE AND REVERBERATION

CROSS-REFERENCES TO RELATED APPLICATIONS

This application is a continuation of copending International Application No. PCT/EP2018/075529, filed Sep. 20, 2018, which is incorporated herein by reference in its entirety, and additionally claims priority from European Applications Nos. EP 17 192 396.4, filed Sep. 21, 2017, and EP 18 158 479.8, filed Feb. 23, 2018, all of which are incorporated herein by reference in their entirety.

Embodiments according to the invention are related to a signal processor for providing a processed audio signal.

Further embodiments according to the invention are related to a method for providing a processed audio signal.

Further embodiments according to the invention are related to a computer program for performing said methods.

Embodiments according to the invention are related to a method and apparatus for online dereverberation and noise reduction (for example, using a parallel structure) with reduction control.

Further embodiments according to the invention are related to linear prediction based online dereverberation and noise reduction using alternating Kalman filters.

Embodiments according to the invention relate to a signal processor, a method and a computer program for noise reduction and reverberation reduction.

BACKGROUND OF THE INVENTION

Audio signal processing, speech communication and audio transmission are continuously developing technical fields. However, when handling audio signals, it is often found that noise and reverberation degrade the audio quality.

For example, in distant speech communication scenarios, where the desired speech source is far from the capturing device, the speech quality and intelligibility is typically degraded due to high levels of reverberation and noise compared to the desired speech level.

Also the performance of speech recognizers degrades drastically in distant talking scenarios [15],[34].

Therefore, dereverberation in noisy environments for real-time frame-by-frame processing with high perceptual quality remains a challenging and partly unsolved task.

State-of-the-art multichannel dereverberation algorithms are based on spatio-spectral filtering [2], [27], system identification [25], [26], acoustic channel inversion [20], [22] or linear prediction using an autoregressive (AR) reverberation model [21],[29],[32]. Successful application of the linear prediction based approaches was achieved by using a multichannel autoregressive (MAR) model for each short-time Fourier transform (STFT) domain frequency band. Advantages of methods based on the MAR model are that they are valid for multiple sources, they directly estimate a dereverberation filter of finite length, the needed filters are relatively short, and they are suitable as pre-processing techniques for beamforming algorithms. A great challenge of the MAR signal model is the integration of additive noise, which has to be removed in advance [30], [32] without destroying the relations between neighboring time-frames of the reverberant signal. In [33], a generalized framework for the multichannel linear prediction methods called blind impulse response shortening was presented, which aims at shortening the reverberant tail in each microphone and results in the same number of output as input channels, while preserving the inter-microphone correlation of the desired signal.

As the first solutions based on the multichannel linear prediction framework were batch algorithms, further efforts have been made to develop online algorithms, which are suitable for real-time processing [4, 12, 13, 31, 35]. However, the reduction of additive noise in an online solution has been considered only in [31] to the best of our knowledge.

In view of the conventional solutions, there is a desire for a concept which provides an improved tradeoff between complexity, stability and signal quality when reducing both noise and reverberation of an audio signal.

SUMMARY

An embodiment may have a signal processor for providing one or more processed audio signals on the basis of one or more input audio signals, wherein the signal processor is configured to estimate coefficients of an autoregressive reverberation model using the one or more input audio signals and one or more delayed noise-reduced reverberant signals acquired using a noise reduction; and wherein the signal processor is configured to provide one or more noise-reduced reverberant signals using the input audio signal and the estimated coefficients of the autoregressive reverberation model; and wherein the signal processor is configured to derive one or more noise-reduced and reverberation-reduced output signals using the one or more noise-reduced reverberant signals and the estimated coefficients of the autoregressive reverberation model.

Another embodiment may have a method for providing one or more processed audio signals on the basis of one or more input audio signals, wherein the method includes estimating coefficients of an autoregressive reverberation model using the one or more input audio signals and one or more delayed noise-reduced reverberant signals acquired using a noise reduction; and wherein the method includes providing one or more noise-reduced reverberant signals using the one or more input audio signals and the estimated coefficients of the autoregressive reverberation model; and wherein the method includes deriving one or more noise-reduced and reverberation-reduced output signals using the one or more noise-reduced reverberant signals and the estimated coefficients of the autoregressive reverberation model.

Another embodiment may have a non-transitory digital storage medium having a computer program stored thereon to perform the method for providing one or more processed audio signals on the basis of one or more input audio signals, wherein the method includes estimating coefficients of an autoregressive reverberation model using the one or more input audio signals and one or more delayed noise-reduced reverberant signals acquired using a noise reduction; and wherein the method includes providing one or more noise-reduced reverberant signals using the one or more input audio signals and the estimated coefficients of the autoregressive reverberation model; and wherein the method includes deriving one or more noise-reduced and reverberation-reduced output signals using the one or more noise-reduced reverberant signals and the estimated coefficients of the autoregressive reverberation model, when said computer program is run by a computer.

An embodiment according to the invention creates a signal processor for providing a processed audio signal (for example, a noise-reduced and reverberation-reduced audio signal, which may be a single-channel audio signal or a multi-channel audio signal) (or generally speaking, one or more processed audio signals) on the basis of an input audio signal (for example, a single-channel or a multi-channel input audio signal) (or generally speaking, on the basis of one or more input audio signals). The signal processor is configured to estimate coefficients of an (for example, multi-channel) autoregressive reverberation model (for example, AR coefficients or MAR coefficients) using the input audio signal (for example, the noisy and reverberant input audio signal or multiple noisy and reverberant input audio signals, or directly an observed signal y(n) which may, for example, originate from one or more microphones) (or, generally speaking, using one or more input audio signals) and (one or more) delayed noise-reduced reverberant signals obtained using a noise reduction (or a noise reduction stage). For example, the delayed noise-reduced reverberant signal may comprise (one or more) past noise-reduced reverberant signals which may be represented by $\hat{x}(n)$. For example, the estimation of the coefficients may be performed by an AR coefficient estimation stage or by an MAR coefficient estimation stage of the signal processor.

Moreover, the signal processor is configured to provide a noise-reduced reverberant signal (for example, of a current frame) (or, generally speaking, one or more noise-reduced reverberant signals) using the input audio signal (which may, for example, be a noisy and reverberant input audio signal or which may, for example, be the noisy observed signal y(n) which may originate from one or more microphones) and the estimated coefficients of the autoregressive reverberation model (which may be a multi-channel autoregressive reverberation model) (and wherein the estimated coefficients may, for example, be associated with the current frame and may, for example, be called "MAR coefficients"). Moreover, the part of the signal processor configured to provide the noise-reduced reverberant signal may be considered as a "noise reduction stage".

Moreover, the audio signal processor is configured to provide a noise-reduced and reverberation-reduced output signal (or, generally speaking, one or more noise-reduced and reverberation-reduced output signals) using the noise-reduced (reverberant) signal (or, generally speaking, one or more noise-reduced, reverberant signals) and the estimated coefficients of the autoregressive reverberation model (or multi-channel autoregressive reverberation model). This may, for example, be performed using a reverberation estimation and a signal subtraction.

This embodiment according to the invention is based on the finding that it is possible to overcome a causality problem, which is found in some conventional solutions, by estimating the coefficients of the autoregressive reverberation model associated with a certain frame on the basis of a delayed and noise reduced reverberant signal which may be associated with one or more preceding frames, and that it is possible to provide the noise reduced reverberant signal of the current frame using the input audio signal and the estimated coefficients of the autoregressive reverberation model associated with the current frame and obtained on the basis of noise-reduced (and typically reverberant) signals (for example, provided by the noise reduction stage) associated with one or more preceding frames. Accordingly, the computational complexity can be kept reasonably small, since the estimation of the coefficients of the autoregressive reverberation model and the estimation of the noise-reduced reverberant signal can be performed separately and alternatingly. In other words, the separate estimation of the coefficients of the autoregressive reverberation model and of the noise-reduced reverberant signal can be performed more efficiently than a joint estimation of coefficients of an autoregressive reverberation model and of a noise-reduced reverberant signal, and also more efficiently than a joint (one-step) estimation of a noise-reduced and reverberation-reduced audio signal. Nevertheless, it has been found that the consideration of delayed (or, equivalently, past) noise-reduced reverberant signals obtained using a noise reduction in the estimation of the coefficients of the autoregressive reverberation model results in a reasonably good estimation of the coefficients of the autoregressive reverberation model, such that there is no severe degradation of the audio quality of the processed signal (output signal). Accordingly, it is possible to alternatingly estimate coefficients of the autoregressive reverberation model and frames of the noise reduced reverberant signal while still obtaining a good audio quality.

Consequently, the tradeoff between complexity, stability and signal quality can be considered as good.

In an embodiment, the signal processor is configured to estimate coefficients of a multi-channel autoregressive reverberation model. It has been found that the concept described herein is well-suited for a handling of multi-channel signals and brings along particular improvements of the complexity for such multi-channel signals.

In an embodiment, the signal processor is configured to use estimated coefficients of the autoregressive reverberation model associated with a currently processed portion (for example, a time-frame having a frame index n) of the input audio signal in order to produce the noise-reduced reverberant signal associated with the currently processed portion (for example, a time-frame having frame index n) of the input audio signal. Accordingly, the provision of the noise-reduced reverberant signal associated with the currently processed portion may rely on the previous estimation of the coefficients of the autoregressive reverberation model associated with the currently processed portion of the input audio signal, or the estimation of the coefficients of the autoregressive reverberation model associated with a currently processed portion (or frame) may precede the provision of the noise-reduced reverberant signal associated with the currently processed portion (or frame). Accordingly, when processing an audio frame with frame index n, the estimation of the coefficients of the autoregressive reverberation model may be performed first (for example, using a past noise reduced but reverberant signal) and the provision of the noise-reduced reverberant signal associated with the currently processed frame may be performed then. It has been found that such an order of the processing results in particularly good results, while a reverse order will typically not perform quite as good.

In an embodiment, the signal processor is configured to use one or more delayed noise-reduced reverberant signals (or, alternatively, a noise-reduced reverberant signal) associated with (or based on) a previously processed portion (for example, a frame having frame index n−1) of the input audio signal (for example, an input signal y(n)) for an estimation of coefficients of the autoregressive reverberation model associated with the currently processed portion (for example, having a frame index n) of the input audio signal. By using a noise-reduced reverberant signal associated with the previously processed portion (or frame) of the input audio signal for an estimation of a coefficient of the autoregressive reverberation model associated with a currently processed portion (or frame) of the input audio signal, a causality problem can be avoided, since the provision of the noise-reduced reverberant signal associated with the previously processed frame can typically be provided before the estimation of the coefficients of the autoregressive reverberation model associated with the currently processed portion (or frame) of the input audio signal. Also, it has been found that the usage of a noise reduced reverberant signal associated with a previously processed portion of the input audio signal results in a sufficiently good estimation of the coefficients of the autoregressive reverberation model.

In an embodiment, the signal processor is configured to alternatingly provide estimated coefficients of the autoregressive reverberation model (or multi-channel autoregressive reverberation model) and noise-reduced reverberant signal portions. Moreover, the signal processor is configured to use estimated coefficients (or, alternatively, previously estimated coefficients) of the (advantageously multi-channel) autoregressive reverberation model for the provision of the noise-reduced reverberant signal portions. Moreover, the signal processor is configured to use one or more delayed noise-reduced reverberant signals (or, alternatively, previously provided noise reduced reverberant signal portions) for the estimation of coefficients of the multi-channel autoregressive reverberation model. By performing such an alternating provision of estimated coefficients of the autoregressive reverberation model and of noise-reduced reverberant signal portions, the computational complexity can be kept low and results can still be obtained with little delay. Also, computational instabilities, which could be caused by a joint estimation of coefficients of the multi-channel autoregressive reverberation model and noise reduced reverberant signal portions can be avoided.

In an embodiment, the signal processor may be configured to apply an algorithm minimizing a cost function (for example, a Kalman filter, a recursive least squares filter or a normalized least mean squares (NLMS) filter) in order to estimate the coefficients of the (advantageously multi-channel) autoregressive reverberation model. It has been found that usage of such algorithms is well-suited for estimating the coefficients of the autoregressive reverberation model. The cost function may, for example be defined as shown in equation (15), and the minimization may, for example, fulfill the functionality as shown in equation (17) or minimize the trace of an error matrix, as shown in equation (19). The Minimization of the cost function may, for example, follow equations (20) to (25). The minimization of the cost function may also use steps 4 to 6 of Algorithm 1.

In an embodiment, the cost function used for the estimation of the coefficients of the autoregressive reverberation model (for example, in the algorithm that minimizes a cost function) is an expectation value for a mean squared error of the coefficients of the autoregressive reverberation model, for example, as shown in equation (19). Accordingly, coefficients of the autoregressive reverberation model which are expected to fit well an acoustic environment causing the reverberation can be achieved. It should be noted that expected statistical properties of the MAR coefficient noise and of the noisy dereverberated signals (state and observation noises), for example, be estimated in a separate, preparatory step (for example, using one or more of equations (26) to (29).

In an embodiment, the signal processor may be configured to apply the algorithm for the minimization of the cost function in order to estimate the coefficients of the (advantageously multi-channel) autoregressive reverberation model under the assumption that the noise-reduced reverberant signal is fixed (for example, not affected by the coefficients of the autoregressive reverberation model associated with the currently processed portion of the input audio signal). By making such an assumption, the computational complexity can be reduced significantly and instabilities of the computation can also be avoided. For example, the algorithm of equations (20) to (25) makes such an assumption.

In an embodiment, the signal processor is configured to apply an algorithm for a minimization of a cost function (for example, a Kalman filter or a recursive least squares filter or a NLMS filter) in order to estimate the noise-reduced reverberant signal. The cost function may, for example be defined as shown in equation (16), and the minimization may, for example, fulfill the functionality as shown in equation (18) or minimize the trace of an error matrix, as shown in equation (30). The minimization of the cost function may, for example, follow equations (31) to (36).

In an embodiment, the signal processor is configured to apply an algorithm for a minimization of a cost function (for example, a Kalman filter, a recursive least squares filter or a NLMS filter) in order to estimate the noise-reduced reverberant signal. It has been found that the usage of such an algorithm for a minimization of a cost function is also very efficient for the determination of the noise-reduced reverberant signal, for example, if statistical properties of the noise are known or estimated. Moreover, the computational complexity can be substantially improved if similar algorithms (for example, algorithms minimizing a cost function) are used both for the estimation of the coefficients of the autoregressive reverberation model and for the estimation of the noise-reduced reverberant signal. For example, the algorithm according to equations (31) to (36) may be used, wherein parameters to be used in said algorithm may be determined according to one or more of equations (37) to (42). Also, the functionality may be performed using steps 7 to 9 of Algorithm 1.

In an embodiment, the cost function used for the estimation of the (optionally noise-reduced) reverberant signal is an expectation value for a mean-squared error of the (optionally noise-reduced) reverberant signal. It has been found that such a cost function (for example, according to equation (16) or according to equation (30)) provides for good results and can be evaluated using reasonable computational effort. Moreover, it should be noted that the estimation of the mean squared error of the noise-reduced reverberant signal is possible, for example, if information (or assumption) regarding statistical characteristics of the noise (for example, the noise covariance matrix) and possibly also regarding the desired signal (for example, the desired speech covariance matrix) are available.

In an embodiment, the signal processor is configured to apply the algorithm for the minimization of the cost function in order to estimate the (optionally noise-reduced) reverberant signal under the assumption that the coefficients of the autoregressive reverberation model are fixed (for example, not affected by the noise-reduced reverberant signal associated with the currently processed portion of the input audio signal). It has been found that such an "ideal" assumption (which is, for example, made in the computation according to equations (31) to (36)) does not significantly degrade the results of the estimation of the noise-reduced reverberant signal but significantly reduces the computational effort (for example, when compared to a joint estimation of the noise-reduced reverberant signal and the coefficients of the autoregressive reverberation model, or when compared to a direct estimation of a noise-reduced and reverberation-reduced output signal (in a single-step procedure)).

Furthermore, the assumption allows for an alternating procedure in which the noise-reduced reverberant signal and the coefficients of the autoregressive reverberation model are estimated in a separated manner (for example, by alternatingly performing steps 4 to 6 and steps 7 to 9 of Algorithm 1).

In an embodiment, the signal processor is configured to determine a reverberation component on the basis of estimated coefficients of the (advantageously multi-channel) autoregressive reverberation model and on the basis of one or more delayed noise-reduced reverberant signals (or, alternatively, on the basis of the noise-reduced reverberant signal) associated with a previously processed portion (for example, a frame) of the input audio signal (for example, by filtering the noise-reduced reverberant signal using the estimated coefficients of the autoregressive reverberation model). Moreover, the signal processor is advantageously configured to (at least partially) cancel (for example, subtract) the reverberation component from the noise-reduced reverberant signal associated with a currently processed portion (for example, a frame) of the input audio signal, in order to obtain the noise-reduced and reverberation-reduced output signal (for example, a desired speech signal). This may, for example, be performed using equation (44).

It has been found that the determination of the reverberation component on the basis of the noise-reduced reverberant signal brings along a good result. For example, it is advantageous to estimate the reverberation filter (the MAR coefficients) from the noisy observation y(n) and past noise-free signals X(n−D). Also, it is advantageously assumed that noise has no reverberant characteristics. As only past noise-free signals X(n−D) are needed for the estimation of the MAR coefficients, the used concept can work in a causal manner and keep the computational effort reasonably slow while still achieving good results.

In an embodiment, the signal processor is configured to perform a weighted combination of the input audio signal and of the noise-reduced reverberant signal (for example, according to equation 44), and to also include a reverberation component in the weighted combination (for example, such that a weighted combination of the input audio signal, a noise-reduced reverberant signal and the reverberation component is performed). In other words, a noise-reduced-reverberation-reduced signal is obtained by a weighted combination of the input signal, the noise-reduced signal and the reverberation component. Accordingly, it is possible to fine-tune signal characteristics, like the amount of reverberation and noise reduction. Consequently, signal characteristics of the processed audio signal (for example, the noise-reduced and reverberation-reduced audio signal) can be adjusted in accordance with the requirements in the present situation.

In an embodiment, the signal processor is configured to also include a shaped version of the reverberation component in the weighted combination (for example, such that a weighted combination of the input audio signal, a noise-reduced reverberant signal, the shaped version of the reverberation component and also the reverberation component itself is performed). For example, this can be done as shown in the last equation of the section describing a "Method and apparatus for online dereverberation and noise reduction (using a parallel structure) with reduction control". Accordingly, it is possible to perform a further spectral and dynamic shaping of the residual reverberation. Accordingly, there is an even larger degree of flexibility with respect to the result to be achieved.

In an embodiment, the signal processor is configured to estimate a statistic (for example, a covariance) (or a statistical property) of a noise component of the input audio signal. Such a statistic of the noise component of the input audio signal may, for example, be useful in the estimation (or provision) of a noise-reduced reverberant signal. Also, an estimation (or determination) of a statistic of the noise component of the input audio signal can facilitate a formulation of a cost function because the statistic of the noise component of the input audio signal can be used as a part of said cost function.

In an embodiment, the signal processor is configured to estimate a statistic (for example, a covariance) (or a statistical property) of a noise component of the input audio signal during a non-speech period (wherein, for example, the non-speech period is detected using a speech detector). It has been found that a detection of non-speech periods is possible with reasonable effort and it has also been found that the noise which is present during non-speech periods is typically also present during the speech periods without too many changes. Accordingly, it is possible to efficiently obtain the statistics of the noise component, which are useable for the provision of the noise-reduced reverberant signal.

In an embodiment, the signal processor is configured to estimate the coefficients of the (advantageously multi-channel) autoregressive reverberation modeled using a Kalman filter. It has been found that such a Kalman filter allows for an efficient computation and is well-adapted to the requirements of the signal processing task. For example, the implementation according to equations (20) to (25) can be used.

In an embodiment, the signal processor is configured to estimate the coefficients of the (advantageously multi-channel) autoregressive reverberation model on the basis of an estimated error matrix of a vector of coefficients of the (advantageously multi-channel) autoregressive reverberation model (for example, associated with a previously processed portion of the audio signal), on the basis of an estimated covariance of an uncertainty noise of the vector of a coefficient of the (advantageously multi-channel) autoregressive reverberation model (for example, as given in equation (26)), on the basis of a previous vector of (estimated) coefficients of the (advantageously multi-channel) autoregressive reverberation model (for example, associated with a previously processed portion or version of the input audio signal), on the basis of one or more delayed noise-reduced reverberant signals delayed noise-reduced reverberant signals (for example, (past) noise-reduced reverberant signals, represented by $\hat{x}(n)$, for example associated with previous portions or frames of the input audio signal), (optionally) on the basis of an estimated covariance associated with noisy (for example, non-noise-reduced) but reverberation-reduced (or reverberation-free) signal components of the input audio signal, and on the basis of the input audio signal. It has been found that estimating the coefficients of the autoregressive reverberation model on the basis of these input variables is both computationally efficient and brings along accurate estimates of the coefficients of the autoregressive reverberation model.

In an embodiment, the signal processor is configured to estimate the noise-reduced reverberant signal using a Kalman filter. It has been found that usage of such a Kalman filter (which may implement the functionality as given in equations 31 to 36) is also advantageous for the estimation of the noise-reduced reverberant signal. Also, using a Kalman filter both for the estimation of the coefficient of the autoregressive reverberation model and for the estimation of the noise-reduced reverberant signal can provide good results.

In an embodiment, the signal processor is configured to estimate the noise-reduced reverberant signal on the basis of an estimated error matrix of the noise-reduced reverberant signal (for example, associated with a previously-processed portion or frame of the input audio signal, for example), on the basis of an estimated covariance of a desired speech signal (for example, associated with a currently processed portion or frame of the input audio signal, for example, as given in equations 37 to 42), on the basis of one or more previous estimates of the noise-reduced reverberant signal (for example, associated with one or more previously processed portions or frames of the input audio signal), on the basis of a plurality of coefficients of the (advantageously multi-channel) autoregressive reverberation model (for example, associated with the currently processed portion or frame of the input audio signal, for example defining a matrix F(n)), on the basis of an estimated noise covariance associated with the input audio signal, and on the basis of the input audio signal. It has been found that the estimation of the noise-reduced reverberant signal on the basis of these quantities is both computationally efficient and provides for a good quality of the audio signal.

In an embodiment, the signal processor is configured to obtain an estimated covariance associated with noisy but reverberation-reduced (or non-reverberant) signal components of the input audio signal on the basis of a weighted combination (for example, according to equation 28) of a recursive covariance estimate determined recursively using previous estimates of noisy but reverberation-reduced (or non-reverberant) signal components of the input audio signal (for example, associated with previously processed portions or frames of the input audio signal, for example according to equation 29) and of an outer product of an (for example, intermediate) estimate of noisy but reverberation-reduced (or non-reverberant) signal components of the input audio signal (for example, associated with a currently processed portion of the input audio signal). For example, the intermediate estimate of the noisy but reverberation-reduced signal components may be obtained as an innovation in a Kalman filtering process (for example, according to equation (22)). For example, the intermediate estimate may be a prediction using predicted coefficients (for example, as determined by equation (21)).

It has been found that such a concept provides for a good estimate of the covariance associated with noisy but reverberation-reduced (or non-reverberant) signal components with reasonable computational complexity.

In an embodiment, the recursive covariance estimate of the desired signal plus noise is based on an estimation of the noisy but reverberation-reduced (or non-reverberant) signal components of the input audio signal computed using final estimate coefficients of the (advantageously multi-channel) autoregressive reverberation model and using a final estimate of the noise-reduced reverberant signal (for example, according to equation (29) in combination with the definition of $\hat{u}(n)$). Alternatively or in addition, the signal processor is configured to obtain the outer product of the noisy but reverberation-reduced signal components of the input audio signal on the basis of an intermediate estimate (for example, a prediction) of the coefficients of the (advantageously multi-channel) autoregressive reverberation model (for example, in a Kalman filtering process) (for example, in order to obtain the covariance estimate)(for example obtained according to equation (21)). By using such a concept (for example, in accordance with equations (28) and (29) described below when taken in combination with the definitions of e(n) and $\hat{u}(n)$) the estimated covariance can be obtained in an efficient manner.

In an embodiment, the signal processor is configured to obtain an estimated covariance associated with a noise-reduced and reverberation-reduced (or non-reverberant) signal component of the input audio signal on the basis of a weighted combination (for example, according to equation (37)) of a recursive covariance estimate determined recursively using previous estimates of a noise-reduced and reverberation-reduced signal components of the input audio signal (for example, associated with previously processed portions or frames of the input audio signal) (which may, for example, be considered as a recursive a-posteriori maximum likelihood estimate) and of an a-priori estimate of the covariance which is based on a currently processed portion of the input audio signal (and obtained, for example, in accordance with equation (41)). In this manner, a meaningful estimate of the covariance associated with the noise-reduced and reverberation-reduced signal component of the input audio signal can be obtained with moderate computational complexity. For example, using the approach described in equation (37) allows for the usage of a Kalman filter for noise reduction with good results.

In an embodiment, the signal processor is configured to obtain the recursive covariance estimate based on an estimation of the noise-reduced and the reverberation-reduced (or non-reverberant) signal components of the input audio signal computed using final estimated coefficients of the (advantageously multi-channel) autoregressive reverberation model and using a final estimate of the noise-reduced reverberant (output) signal (for example, using equation (38)). Alternatively or in addition, the signal processor is configured to obtain the a-priori estimate of the covariance using a Wiener filtering of the input signal (as shown, for example, in equation (41)), wherein a Wiener filtering operation is determined in dependence on the covariance information regarding the input audio signal, in dependence on covariance information regarding a reverberation component of the input audio signal and in dependence on covariance information regarding a noise component of the input audio signal (as shown, for example, in equation (42)). It has been found that these concepts are helpful in efficient computation of the estimated covariance associated with the noise-reduced and reverberation-reduced signal component.

The signal processors described here, and the signal processors defined in the claims, can be supplemented by any of the features, functionalities and details described herein, both individually and taken in combination. Details regarding the computation of different parameters can be used independently. Also details regarding individual processing steps can be used independently.

Another embodiment according to the invention creates a method for providing a processed audio signal (for example, a noise-reduced and reverberation-reduced audio signal, which may be a single-channel audio signal or a multi-channel audio signal) on the basis of an input audio signal (for example, a single-channel or multi-channel input audio signal). The method comprises estimating coefficients of a (advantageously, but not necessarily, multi-channel) autoregressive reverberation model (for example, AR coefficients or MAR coefficients) using the (typically noisy and reverberant) input audio signal (or input audio signals) (for example, directly from the observed signal y(n)) and delayed (or past) noise-reduced reverberant signals obtained using a noise reduction (noise reduction stage) (for example, past noise-reduced reverberant signals $\hat{x}(n)$). This functionality may, for example, be performed by the AR coefficient estimation stage.

Moreover, the method comprises providing a noise-reduced reverberant signal (for example, of a current frame) using the (typically noisy and reverberant) input audio signal (for example, the noisy observed signal y(n)) and the estimated coefficients of the (advantageously multi-channel) autoregressive reverberation model (for example, associated with the current frame). The estimated coefficients of the autoregressive reverberation model may, for example, be "MAR coefficients". Moreover, the functionality of providing the noise-reduced reverberant signal may, for example, be performed by a noise reduction stage.

The method further comprises deriving a noise-reduced and reverberation-reduced output signal using the noise-reduced reverberant signal and the estimated coefficients of the (advantageously multi-channel) autoregressive reverberation model.

This method is based on the same considerations as the above mentioned signal processor, such that the above explanations also apply.

Moreover, the method can be supplemented by any features, functionalities and details described herein with respect to the signal processor, both individually and in combination.

Another embodiment according to the invention creates a computer program for performing the method as described herein when the computer program runs on a computer.

BRIEF DESCRIPTION OF THE DRAWINGS

Embodiments of the present invention will be detailed subsequently referring to the appended drawings, in which:

FIG. 15 (Table 1) shows a table representation of objective measures for varying iSNRs (stationary noise) using measured RIRs, M=2, L=12, $\beta_v$=−10 dB, $\beta_{r,min}$=−15 dB; and FIG. 16 (Table 2) shows a table representation of objective measures for varying iSNRs (babble noise) using measured RIRs, M=2, L=12, $\beta_v$=−10 dB, $\beta_{r,min}$=−15 dB.

DETAILED DESCRIPTION OF THE INVENTION

1. Embodiment According to FIG. 1

Figure 1:
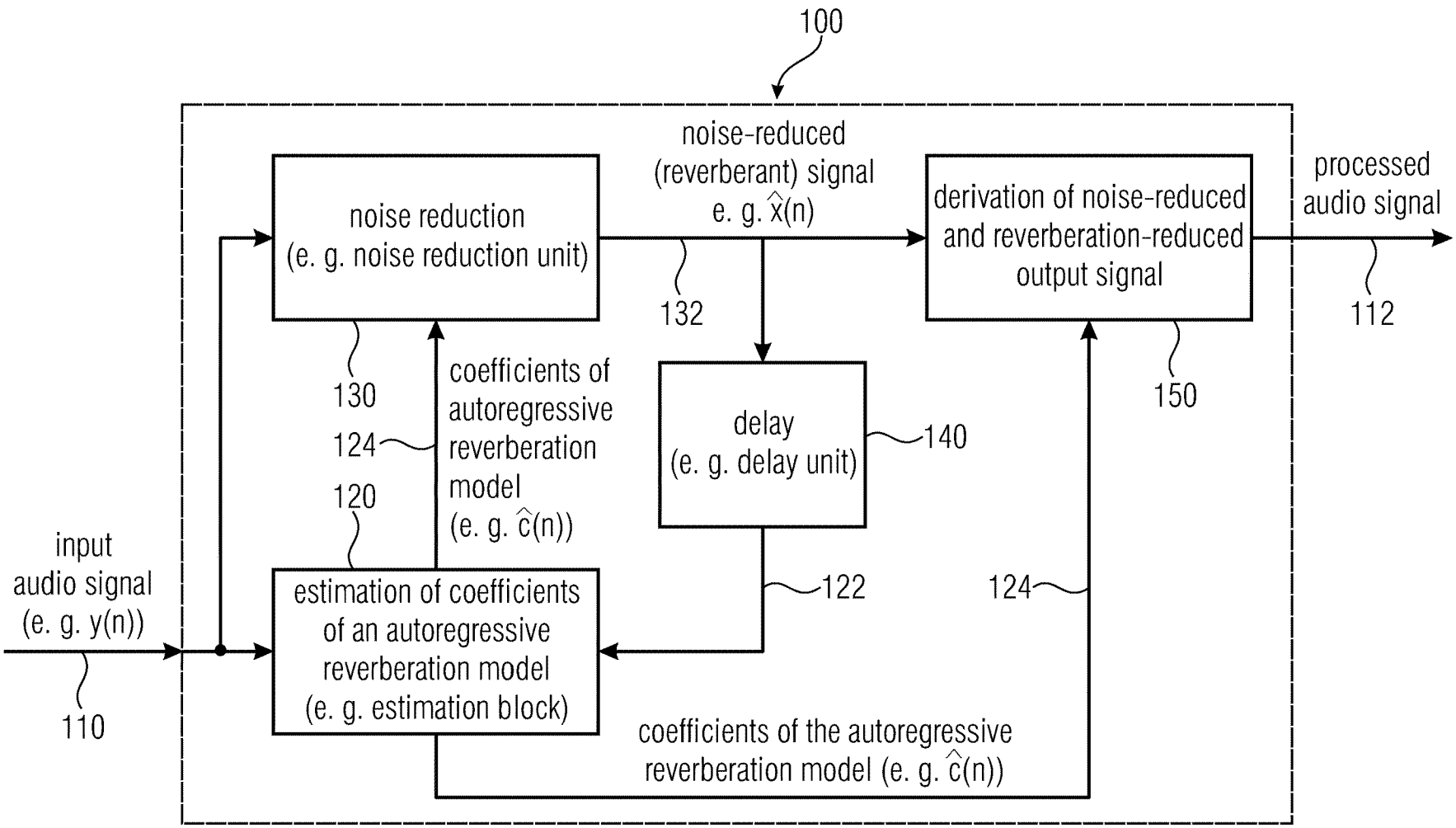
FIG. 1 shows a block schematic diagram of a signal processor, according to an embodiment of the present invention.

FIG. 1 shows a block schematic diagram of a signal processor 100, according to an embodiment of the present invention. The signal processor 100 is configured to receive an input audio signal 110 and is configured to provide, on the basis thereof, a processed audio signal 112, which may, for example, be a noise-reduced and reverberation-reduced audio signal. It should be noted that the input audio signal 110 can be a single-channel audio signal but is advantageously a multi-channel audio signal. Similarly, the processed audio signal 112 can be a single-channel audio signal but is advantageously a multi-channel audio signal. The signal processor 100 may, for example, comprise a coefficient estimation block or coefficient estimation unit 120, which is configured to estimate coefficients 124 of an autoregressive reverberation model (for example, AR coefficients or MAR coefficients of a multi-channel autoregressive reverberation model) using the single-channel or multi-channel input audio signal 110 and a delayed noise-reduced reverberant signal 122.

For example, the estimation of the coefficients of the autoregressive reverberation model 120 and may receive the input audio signal 110 and the delayed noise-reduced reverberant signal 122.

The signal processor 100 also comprises a noise reduction unit or noise reduction block 130 which receives the input audio signal 110 and which provides a noise-reduced (but typically reverberant or non-reverberation-reduced) signal 132. The noise reduction unit or noise reduction block 130 is configured to provide a noise-reduced (but typically reverberant) signal using the (typically noisy and reverberant) input audio signal 110 and the estimated coefficients 124 of the autoregressive reverberation model which are provided by the estimation block or estimation unit 120.

It should be noted here that the noise reduction 130 may, for example, use coefficients 124 of the autoregressive reverberation model which have been obtained on the basis of a previously determined noise-reduced reverberant signal 132 (possibly in combination with the input audio signal 110).

The apparatus 100 optionally comprises a delay block or delay unit 140, which may be configured to obtain the noise-reduced reverberant signal 132 provided by the noise reduction unit or noise reduction block 130 to provide, as an output, a delayed version 122 thereof. Accordingly, the estimation 120 of the coefficients of the autoregressive reverberation model can operate on a previously obtained (derived) noise-reduced reverberant signal (which is provided or derived by the noise reduction block 130) and the input audio signal 110.

The apparatus 100 also comprises a block or unit 150 for the derivation of a noise-reduced and reverberation-reduced output signal, which may serve as the processed audio signal 112. The block or unit 150 advantageously receives the noise-reduced reverberant signal 132 from the noise reduction block or noise reduction unit 130 and the coefficients 124 of the autoregressive reverberation model provided by the estimation block or estimation unit 120. Thus, the block or unit 150 may, for example, remove or reduce reverberation from the noise-reduced reverberant signal 132. For example, an appropriate filtering, in combination with a cancellation operation (for example, in a spectral domain) may be used for this purpose, wherein the coefficients 124 of the autoregressive reverberation model may determine the filtering (which is used to estimate the reverberation).

Regarding the apparatus 100, it should be noted that the separation of functionalities into blocks or units can be considered as an efficient but arbitrary choice. The functionalities described herein could also be distributed differently to a hardware apparatus as long as the fundamental functionality is maintained. Also, it should be noted that the blocks or units could be software blocks or software units which reuse the same hardware (like, for example, a microprocessor).

Regarding the functionality of the apparatus 100, it can be said that the separation between the noise reduction functionality (noise reduction block or noise reduction unit 130) and the estimation of the coefficients of the autoregressive reverberation model (estimation block or estimation unit 120) provides for a reasonably small computational complexity and still allows for obtaining a sufficiently good audio quality. Even though, theoretically, it would be best to estimate the noise-reduced and reverberation-reduced output signal using a joint cost function, it has been found that separately performing the noise reduction and the estimation of the coefficients of the autoregressive reverberation model using separate cost functions can still provide reasonably good results, while complexity can be reduced and stability problems can be avoided. Also, it has been found that the noise-reduced reverberant signal 132 serves as a very good intermediate quality, since the noise-reduced and reverberation-reduced output signal (i.e., the processed audio signal 112) can be derived from the noise-reduced (but reverberant or non-reverberation-reduced) signal 132 with little effort provided that the coefficients 124 of the autoregressive reverberation model are known.

However, it should be noted that the apparatus 100 as described in FIG. 1 can be supplemented by any of the features, functionalities and details described in the following, both individually and taken in combination.

2. Embodiments According to FIGS. 3, 4 and 5

In the following, some additional embodiments will be described taking reference to FIGS. 3, 4 and 5. However, before details of the embodiments will be described, some information regarding conventional solutions will be described and a signal model will be defined.

Generally speaking, methods and apparatuses for online dereverberation and noise reduction (using a parallel structure), optionally with reduction control, will be described.

2.1 Introduction

The following embodiments of the invention are in the field of acoustic field processing, for example to remove reverberation noise from one or multiple microphones.

In distant speech communication scenarios, where the desired speech source is far from the capturing device, the speech quality and intelligibility as well as the performance of speech recognizers is typically degraded due to high levels of reverberation and noise compared to the desired speech level.

Dereverberation methods based on an autoregressive (AR) model per frequency band in the short-time Fourier transform (STFT) domain have been shown to perform superior to other reverberation models. Dereverberation methods based on this model typically solve the problem using approaches related to linear prediction. Furthermore, the general multi-channel autoregressive (MAR) model is valid for multiple sources and can be formulated such that it provides the same number of channels at the output as at the input. Since the resulting enhancement process, which is a linear filter per frequency band across multiple STFT frames, does not change the spatial correlation of the desired signal, the enhancement is suitable as preprocessing for further array processing techniques.

While most existing techniques based on the MAR model are batch algorithms [Nakatani 2010, Yoshioka 2009, Yoshioka 2012], some online algorithms have been proposed in [Yoshioka 2013, Togami 2019, Jukic 2016]. However, the challenging problem in noisy environments using an online algorithm has only been addressed in [Togami 2015].

It has been found that, in noisy environments, the problem can be typically be solved by first performing a noise reduction step, followed by linear prediction-based methods to estimate the MAR coefficients (also known as room regression coefficients) and then filtering the signal.

In embodiments of the invention, a novel parallel structure is proposed to estimate the MAR coefficients and the de-noised signal directly from the observed microphone signals instead of sequential structure. The parallel structure enables a fully causal estimation of potentially time-varying MAR coefficients and solves the ambiguity problem, which of the dependent stages, the MAR coefficient estimation stage or the noise reduction stage, should be executed first. Furthermore, the parallel structure enables the possibility to create an output signal, where the amount of residual reverberation and noise can be controlled efficiently.

2.2 Definitions and Conventional Solutions 2.2.1 Signal Model

The following subsections summarize conventional approaches for dereverberation in noisy environments based on the multichannel autoregressive model.

Using this model, we assume that the microphone signals in the time-frequency domain $Y_m(k,n)$ for $m=\{1, \ldots, M\}$ with frequency and time index k and n written in the vector $y(k,n)=[Y_1(k,n), \ldots, Y_M(k,n)]^T$ can be described by $$y(k,n)=x(k,n)+v(k,n)$$

where the vector x(k,n) denotes the reverberant speech signal at the microphones and the vector v(k,n) denotes additive noise. The reverberant speech signal vector x(k,n) is modeled as a multichannel autoregressive process $$x(k,n)=\sum_{\ell=D}^{L} C_\ell(k,n)x(k,n-\ell)+s(k,n)$$

where the vector s(k,n) denotes the early speech signals at the microphones and the matrices $\mathbf{C}_\ell(k,n)$ for $\ell=\{D, \ldots, L\}$ contain the MAR coefficients. The number of frames L describes the length needed to model the reverberation, while the delay D<L controls the start time of the late reverberation and should, according to an aspect of the invention, be chosen such that there is no correlation between the direct sound contained in s(k,n) and the late reverberation.

The aim (and concept) of this invention (or of embodiments thereof) is to obtain the early speech signals s(k,n) by estimating the reverberant noise-free speech signals and the MAR coefficients, denoted by $\hat{x}(k,n)$ and $\hat{c}_t(k,n)$, respectively. According to an aspect of the invention, using these estimates, the desired signal vector s(k,n) is estimated by the linear filtering process $$\hat{s}(k,n) = \hat{x}(k,n) - \sum_{\ell=D}^{L} \hat{C}_\ell(k,n)\hat{x}(k,n-\ell)$$

For notational simplicity, the frequency index k is omitted in following equations and we reformulate the observed microphone signal using the matrix notation $$y(n) = \underbrace{X(n-D)c(n)}_{r(n)} + s(n) + v(n),$$

where $$X(n) = I_M \otimes [x^T(n-L+D), \ldots, x^T(n)]$$

$$c(n) = Vec\{[C_L(n), \ldots, C_D(n)]^T\},$$

$I_M$ is the M×M identity matrix, ⊗ denotes the Kronecker product, Vec{●} denotes the matrix column stacking operator and the vector r(n) denotes the late reverberation at each microphone.

In the conventional solutions, the MAR coefficients are modeled as deterministic variable, which implies stationarity of c(n). In [Braun2016], a stochastic model for potentially time-varying MAR coefficients was introduced, more specifically the first-order Markov model $$c(n)=c(n-1)+w(n),$$

where w(n) is a random noise modeling the propagation uncertainty of the coefficients. However, in [Braun2016] a solution is only given by assuming no additive noise.

2.2.2 Sequential Online Solution

Methods to estimate the variables x(k,n) and c(n) in a batch algorithm, where the coefficients c(n) are assumed stationary are proposed in [Yoshioka2009, Togami2013]. However, it has been found that in common realistic applications, the acoustic scene, i.e., the MAR coefficients c(n), can be time-varying. The only online solution to the MAR coefficient estimation problem in noisy environments is proposed in [Togami2015], although under the assumption that the MAR coefficients are stationary.

Figure 2:
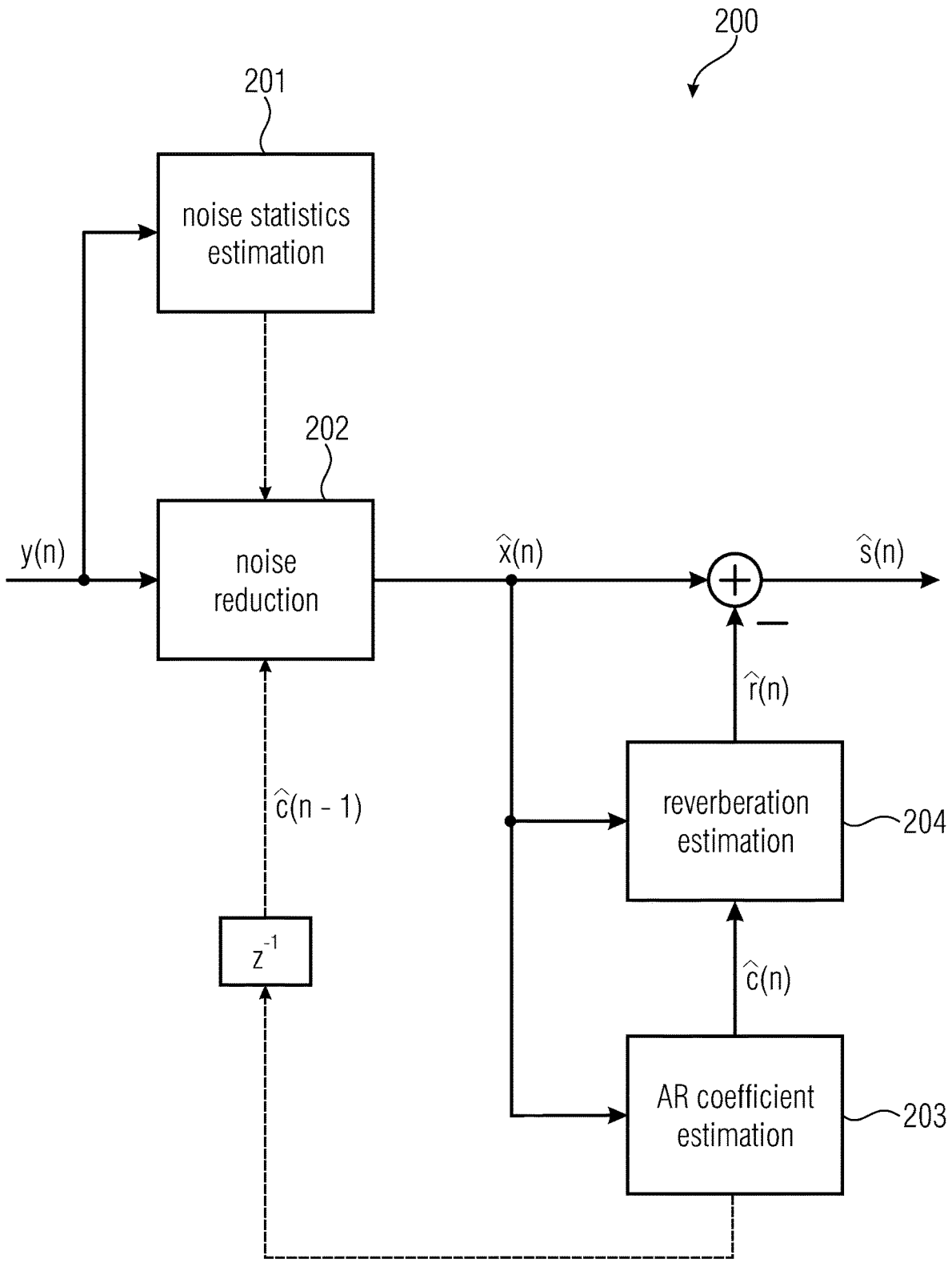
FIG. 2 shows a conventional structure for MAR (multi-channel autoregressive) coefficient estimation in a noisy environment.

Conventional approaches for such similar problems to estimate an AR signal and the AR parameters use a sequential structure as shown in FIG. 2, such as the conventional online approach [Togami2015]. First, a noise reduction stage 202 tries to remove the noise from the observed signals y(n), and in a second step 203 the AR coefficients c(n) are estimated from the output signals of the first stage $\hat{x}(n)$. It has been found that this structure is suboptimal for two reasons: 1) The MAR parameter estimation stage 203 assumes that the estimated signal $\hat{x}(n)$ is noise-free, which is often not possible in practice. 2) To use the information of the MAR coefficients in the noise reduction stage 202, the coefficients have to be assumed stationary, as the assumption c(n)=c(n−1) is needed to feed the estimated MAR coefficients back from the MAR coefficient estimation stage to the noise reduction stage.

To conclude, FIG. 2 shows a block schematic diagram of a conventional structure for MAR coefficient estimation in a noisy environment. The apparatus 200 comprises a noise statistics estimation 201, a noise reduction 202, an AR coefficient estimation 203 and a reverberation estimation 204.

In other words, blocks 201 to 204 are blocks of the conventional sequential noise reduction and the reverberation system.

2.3 Embodiments According to the Present Invention

In the following, three embodiments according to the present invention will be described. FIG. 3 shows a block schematic diagram of embodiment 2 according to the present invention. FIG. 4 shows a block schematic diagram of embodiment 3 according to the present invention. FIG. 5 shows a block schematic diagram of embodiment 4 according to the present invention.

In the following, a brief description of the figures and of the block numbers will be provided.

It should be noted that blocks 301 to 305 are blocks of a proposed noise reduction dereverberation system. It should also be noted that identical reference numerals are used for identical blocks (or for blocks having identical functionalities) in the embodiments according to FIGS. 3, 4 and 5.

In the following, as embodiments of the invention, solutions to the dereverberation problem by estimating the MAR coefficients and the reverberant signal in a causal online manner in the presence of additive noise are proposed. The spatial noise statistics may be estimated in advance by the computation block 301, e.g., as proposed in [Gerkmann 2012].

2.3.1 Embodiment 2: Parallel Structure to Estimate AR Coefficients and Desired Signal FIG. 3 shows a block schematic diagram of an apparatus (or signal processor) according to an embodiment of the present invention (or generally, a block scheme of an embodiment of the proposed invention).

Figure 3:
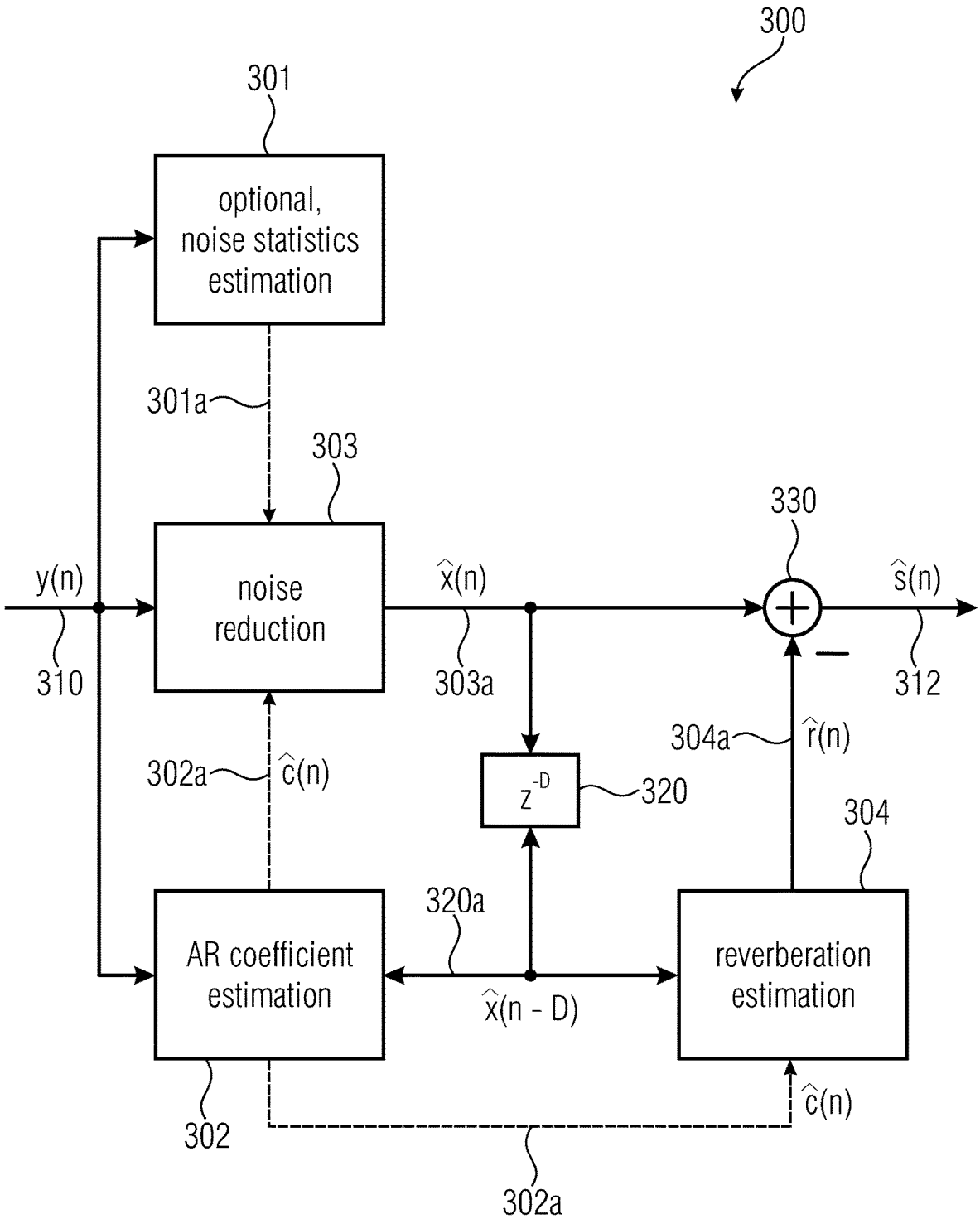
FIG. 3 shows a block schematic diagram of an apparatus (or signal processor) according to the present invention (embodiment 2)

The apparatus 300 according to FIG. 3 is configured to receive an input signal 310 which may be a single-channel audio signal or a multi-channel audio signal. The apparatus 300 is also configured to provide a processed audio signal 312 which may be a noise-reduced and reverberation-reduced signal. The apparatus 300 may, optionally, comprise a noise statistic estimation 301 which may be configured to derive information about a noise statistic on the basis of the input audio signal 310. For example, the noise statistic estimation 301 may estimate statistics of a noise in the absence of a speech signal (for example, during speech pauses).

The apparatus 300 also comprises a noise reduction 303 which receives the input audio signal 310, an information 301*a* about the noise statistics and coefficients 302*a* of an autoregressive reverberation model (which are provided by the autoregressive coefficient estimation 302). The noise reduction 303 provides a noise-reduced (but typically reverberant) signal 303*a*.

The apparatus 300 also comprises an autoregressive coefficient estimation 302 (AR coefficient estimation) which is configured to receive the input audio signal 301 and a delayed version (or past version) of the noise-reduced (but typically reverberant) signal 303*a* provided by the noise reduction 303. Moreover, the autoregressive coefficient estimation 302 is configured to provide the coefficients 302*a* of the autoregressive reverberation model.

The apparatus 300 optionally comprises a delayer 320 which is configured to derive the delayed version 320*a* from the noise-reduced (but typically reverberant) signal 303*a* provided by the noise reduction 303.

The apparatus 300 also comprises a reverberation estimation 304, which is configured to receive the delayed version 320*a* of the noise-reduced (but typically reverberant) signal 303*a* provided by the noise reduction 303. Moreover, the reverberation estimation 304 also receives the coefficients 302*a* of the autoregressive reverberation model from the autoregressive coefficient estimation 302. The reverberation estimation 304 provides an estimated reverberation signal 304*a*.

The apparatus 300 also comprises a signal subtractor 330 which is configured to remove (or subtract) the estimated reverberation signal 304*a* from the noise-reduced (but typically reverberant) signal 303*a* provided by the noise reduction 303, to thereby obtain the processed audio signal 312, which is typically noise-reduced and reverberation-reduced.

In the following, the functionality of the apparatus 300 according to FIG. 3 will be described in more detail. In particular, it should be noted that the autoregressive coefficient estimation 302 uses both the input signal 310 and the noise-reduced (but typically reverberant) output signal 303*a* of the noise reduction 303 (or, more precisely, a delayed version 320*a* thereof). Accordingly, the autoregressive coefficient estimation 302 can be performed separately from the noise reduction 303, wherein the noise reduction 303 can nevertheless take benefit of the coefficients 302*a* of the autoregressive reverberation model, and wherein the autoregressive coefficient estimation 302 can nevertheless take benefit of the noise-reduced signal 303*a* provided by the noise reduction 303. The reverberation can finally be removed from the noise-reduced (but typically reverberant) signal 303*a* provided by the noise reduction 303.

In the following, the functionality of the apparatus 300 will be described again in other words.

By using an alternating minimization procedure to estimate the MAR coefficients c(n) and the reverberant signals x(n) (estimates designated with $\hat{c}(n)$ and $\hat{x}(n)$), we obtain a three-step procedure, where in the first step (Block 302) the MAR coefficients are estimated directly from the observed signals y(n) needing only information about past reverberant signals contained in the matrix X(n−D). In the second step (Block 303), noise reduction is performed to estimate the reverberant signals x(n) from the noisy observations y(n). The noise reduction step needs knowledge of the MAR coefficients c(n), which are available as current estimate due to the parallel structure from 302 and the noise statistics from 301.

In the third step (Block 304), the late reverberation is computed by $\hat{r}(n)=\hat{X}(n-D)\hat{c}(n)$ and subtracted from the reverberant signals $\hat{x}(n)$ to obtain the estimated desired speech signals $\hat{s}(n)$ (e.g., block 330). The procedure is illustrated in FIG. 3.

Online estimation of c(n) and x(n) can be performed by recursive estimators such as Kalman filters, while the needed covariances can be estimated in the maximum likelihood sense. A concrete example how to compute c(n) and x(n) is described in Section 3 explaining "Linear Prediction based online dereverberation and noise reduction using alternating Kalman filters".

However, also other estimation methods such as recursive least squares, NLMS etc., could be used instead in the Blocks 302 and 303. The noise covariance matrix $\Phi_v(n)=E\{v(n)v^H(n)\}$ (which may be requested by the information 301*a*) should be advantageously be known in advance and can, for example, be estimated during periods of speech absence. Suitable methods for the noise statistics estimation in 301 using the speech presence probability is described in [Gerkmann2012,Taseska2012].

2.3.2 Embodiments 3 and 4: Reduction Control

In the following, embodiments according to FIGS. 4 and 5 will be described.

Figure 4:
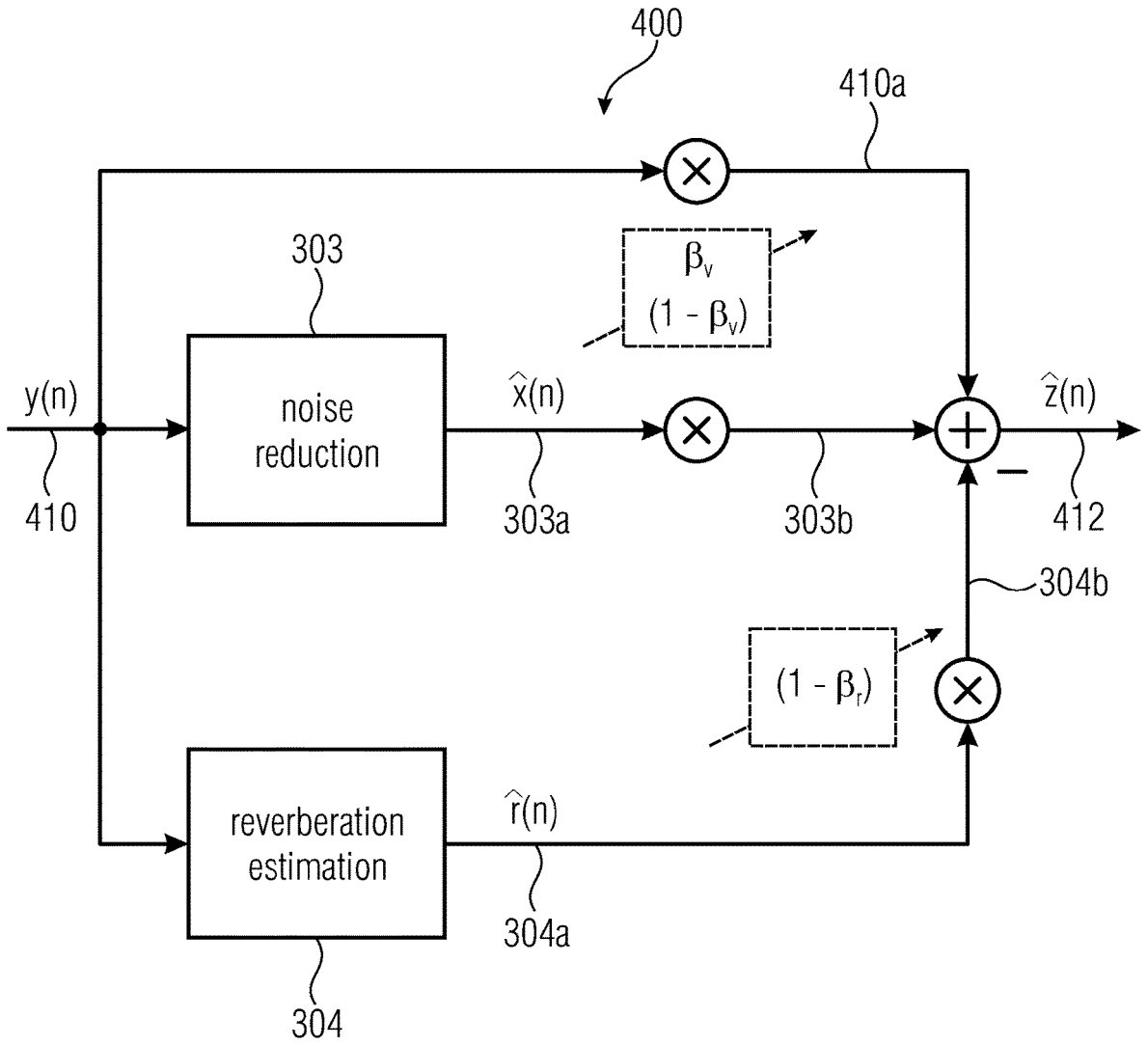
FIG. 4 shows a block schematic diagram of an apparatus (or signal processor) according to the present invention (embodiment 3)

FIG. 4 shows a block schematic diagram of an apparatus or signal processor 400 according to an embodiment of the present invention. The signal processor 400 comprises a noise reduction 303 and a reverberation estimation 304. The noise reduction 303 provides a noise-reduced (but typically reverberant) signal 303*a*. The reverberation estimation 304 provides a reverberation signal 304*a*. For example, the noise reduction 303 of the apparatus 400 may comprise the same functionality as the noise reduction 303 of the apparatus 300 (possibly in combination with block 301).

Moreover, the reverberation estimation 304 of the apparatus 400 may, for example, perform the functionality of the reverberation estimation 304 of the apparatus 300, possibly in combination with the functionality of blocks 302 and, 320.

Moreover, the apparatus 400 is configured to combine a scaled version of the input signal 410 (which may correspond to the input signal 310) with a scaled version of the noise-reduced (but typically reverberant) signal 303*a* and also with a scaled version of the reverberation signal 304*a* provided by the reverberation estimation 304. For example, the input signal 410 may be scaled with a scaling factor of $\beta_v$. Also, the noise-reduced signal 303*a* provided by the noise reduction 303 may be scaled by a factor of $(1-\beta_v)$. In addition, the reverberation signal 304*a* may be scaled by a factor of $(1-\beta_r)$. For example, the scaled version 410*a* of the input signal 410 and the scaled version 303*b* of the noise-reduced signal 303*a* may be combined with same signs. In contrast, the scaled version 304*b* of the reverberation signal 304*a* may be subtracted from the sum of signals 410*a*, 303*b*, to thereby obtain the output signal 412. To conclude, the scaled version 410*a* of the input signal may be combined with the scaled version 303*b* of the noise reduced signal 303*a*, and at least a part of the reverberation may be removed by subtracting the scaled version 304*b* of the reverberation signal 304*a* obtained by the reverberation estimation 304.

Accordingly, the characteristics of the output signal 412 can be adjusted in a desired manner. The degree of noise reduction and the degree of reverberation reduction can be adjusted by appropriately choosing the scale factors, for example $\beta_v$ and $\beta_r$.

Figure 5:
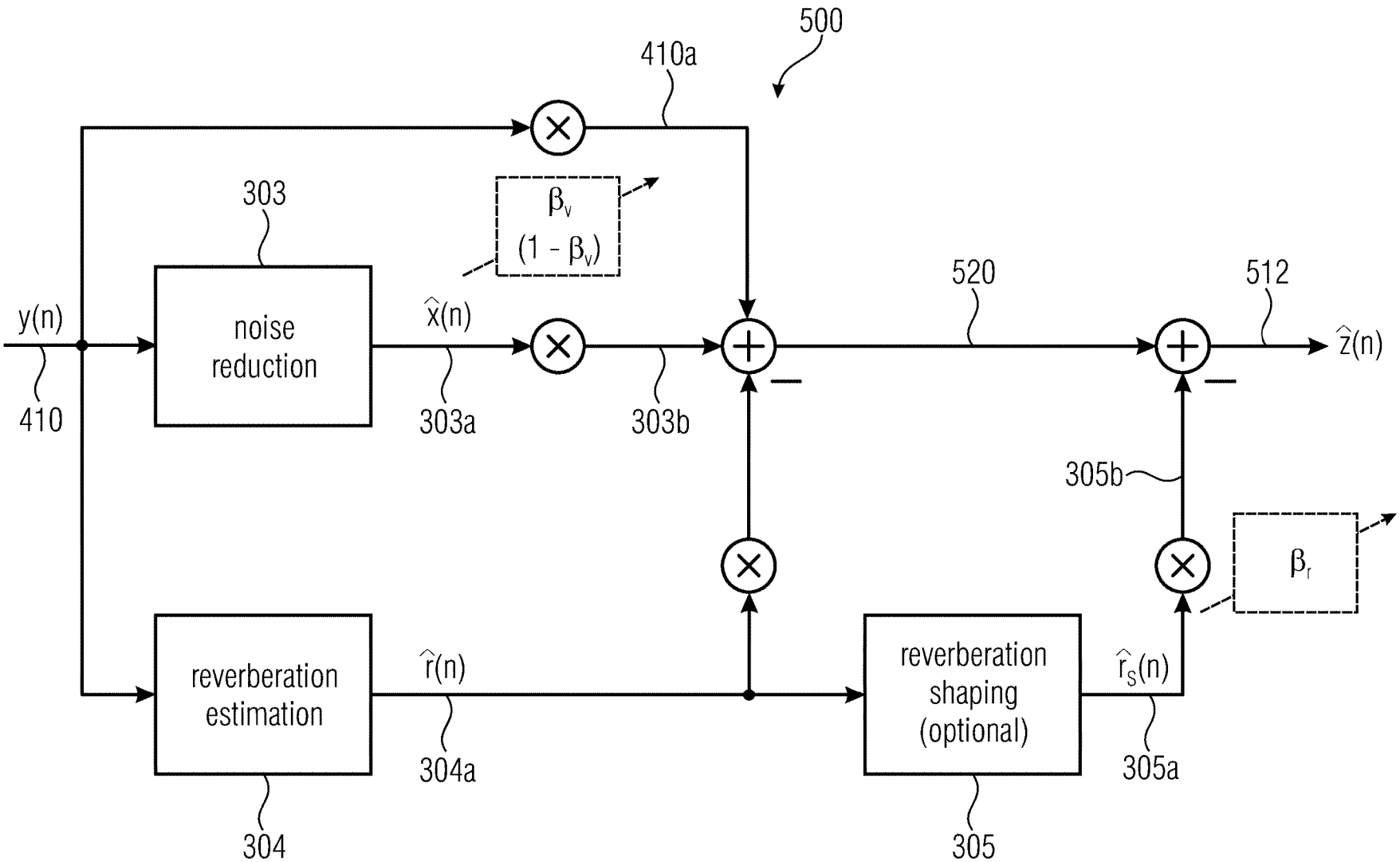
FIG. 5 shows a block schematic diagram of an apparatus (or signal processor) according to the present invention (embodiment 4)

FIG. 5 shows a block schematic diagram of another apparatus or signal processor, according to an embodiment of the invention.

The apparatus or signal processor 500 according to FIG. 5 is similar to the apparatus or signal processor 400 according to FIG. 4, such that reference is made to the above explanations and such that equal components will not be described again.

However, the apparatus 500 also comprises a reverberation shaping 305 which receives the reverberation signal 304*a* provided by the reverberation estimation. The reverberation shaping 305 provides a shaped reverberation signal 305*a*.

According to the concept as shown in FIG. 5, the reverberation signal 304*a* is subtracted from the sum of the scaled noise reduced signal 303*b* and the scaled input signal 410*a*. accordingly, an intermediate signal 520 is obtained. Moreover, a scaled version 305*b* of the shaped reverberation signal 305*a* is added to the intermediate signal 520 in order to obtain an output signal 512.

However, a direct combination of the signals 410*a*, 303*b*, 304*a* and 305*b* would be possible as well (without using an intermediate signal).

Accordingly, the apparatus 500 allows to adjust characteristics of the output signal 512. The original reverberation can be removed (at least to a large degree), for example by subtracting the (estimated) reverberation signal 304*a* from the sum of signals 303*b*, 410*a*. Accordingly, a modified (shaped) reverberation signal 305*b* can be added (for example after an optional scaling), to thereby obtain the output signal 512. Accordingly, the output signal can be obtained with a shaped reverberation and with an adjustable degree of noise reduction.

In the following, the embodiment according to FIGS. 4 and 5, FIG. 5 will be summarized in other words.

The parallel structure shown in FIG. 3 (with some extensions and amendments) allows for an easy and effective way to control the amount of reverberation and noise reduction. Such a control can be desired in speech communication scenarios to keep e.g., some residual noise and reverberation for perceptual reasons or to mask artifacts produced by the reduction algorithm.

We define the (desired) new output signal $$z(n)=s(n)+\beta_r r(n)+\beta_v v(n),$$

where $\beta_r$ and $\beta_v$ are the control parameters for the residual reverberation and noise. By re-arranging the equation and replacing unknown variables by the available estimates, we can compute the controlled output signals (e.g., the output signal (412) by $$\hat{z}(n)=\beta_v y(n)+(1-\beta_v)\hat{x}(n)-(1-\beta_r)\hat{r}(n)$$

as shown in FIG. 4. The processing Blocks 301 and 302 are omitted in this FIG. 4 (but can optionally be added).

For further spectral and dynamic shaping of the residual reverberation, an optional processing of the reverberation signal $\hat{r}(n)$ can be inserted as shown in FIG. 4 in Block 305 (for example, as shown in FIG. 5). The output signal with reverberation shaping is then computed by $$\hat{z}(n)=\beta_v y(n)+(1-\beta_v)\hat{x}(n)-\hat{r}(n)+\beta_r \hat{r}_s(n),$$

where $\hat{r}_s(n)$ is the shaped reverberation signal by Block 305. The reverberation shaping can be performed for example by an equalizer or compressor/expander commonly used in audio and music production.

3. Embodiments According to FIGS. 7 and 9

In the following, further embodiments for a linear-prediction based online dereverberation and noise reduction using alternating Kalman filters will be described.

For example, Linear Prediction Based Online Dereverberation and Noise Reduction Using Alternating Kalman Filters will be described.

3.1 Introduction and Overview

In the following, an overview of the concept underlying embodiments according to the present invention will be described.

Multi-channel linear prediction based dereverberation in the short-time Fourier transform (STFT) domain has been shown to be highly effective. However, it has been found that to use such methods in the presence of noise, especially in the case of online processing, remains a challenging problem. To address this problem, an alternating minimization algorithm that consists of two interactive Kalman filters to estimate the noise-free reverberant signal and the multi-channel autoregressive (MAR) coefficients is proposed. The desired dereverberated signals are then obtained by filtering the noise-free signals (or noise-reduced signals) using the estimated MAR coefficients.

It has been found that existing sequential enhancement structures used for similar problems have a causality issue that both the optimal noise reduction and the reverberation stages depend on the current output of each other. To overcome this causality problem, a novel parallel dual Kalman structure is developed, which solves the problem using alternating Kalman filters. It has been found that this causality is important when dealing with time-variant acoustic scenarios, where the MAR coefficients are non-stationary.

The proposed method is evaluated using simulated and measured acoustic impulse responses and compared to a method based on the same signal model. In addition, a method (and concept) to control the amount of reverberation and noise reduction independently is described.

To conclude, embodiments according to the invention can be used for a dereverberation. Embodiments according to the invention use a multi-channel linear prediction and an autoregressive model. Embodiments according to the invention use a Kalman filter, advantageously in combination with an alternating minimization.

In the present application (and, in particular, in this section) a method (and concept) based on the MAR reverberation model is proposed to reduce reverberation and noise using an online algorithm. The proposed solution outperforms the noise-free solution presented in [3] where the MAR coefficients are modeled by a time-varying first-order Markov model. To obtain the desired dereverberated speech signals, it is possible to estimate the MAR coefficients and the noise-free reverberant speech signal.

The proposed solution has several advantages to conventional solutions: Firstly in contrast to the sequential signal and autoregressive (AR) parameter estimation methods used for noise reductions presented in [8] and [17], a parallel estimation structure as an alternating minimization algorithm using, for example, two interactive Kalman filters to estimate the MAR coefficients and the noise-free reverberant signals is proposed. This parallel structure allows a fully causal estimation chain as opposed to a sequential structure, where the noise reduction stage would use outdated MAR coefficients.

Secondly, in the proposed method we (optionally) assume a randomly time-varying MAR process instead of computing a time-invariant linear filter and a time-varying non-linear filter like in an expectation-maximization (EM) algorithm proposed in [31]. Thirdly, the proposed algorithm and concept does not require multiple iterations per time frame but can be an adaptive algorithm that converges over time. Finally, as an optional extension, a method to control the amount of reverberation and noise reduction independently is also proposed.

The remainder of this section is organized as follows:

In subsection 2, the signal models for the reverberant signal, the noisy observation and the MAR coefficients are presented and the problem is formulated. In subsection 3, two alternating Kalman filters are derived as part of an alternating minimization problem to estimate the MAR coefficients and the noise-free signals. An optional method to control the reverberation and noise reduction is presented in subsection 4. In subsection 5, the proposed method and concept is evaluated and compared to state-of-the-art methods. Some conclusions are presented in subsection 6.

Regarding the notation, it should be noted that factors are denoted as lower case bold symbols, for example a. Matrices are denoted as upper case bold symbols, for example A and scalars in normal font (e.g., A). Estimated quantities are denoted by $\hat{\bullet}$, for example $\hat{A}$.

In the embodiments, estimated quantities may optionally take the place of ideal quantities.

3.2 Signal Model and Problem Formulation

We assume, for example, an array of M microphones with arbitrary directivity and arbitrary geometry. The microphone signals are given in the SIFT domain by $Y_m(k,n)$ for $m\in\{1 \ldots M\}$, where k and n denote the frequency and time indices, respectively. In vector notation, the microphone signals can be written as $y(k,n)=[1Y_1(k,n)Y_M(k,n)]^T$. We assume that the microphone signal vector is composed as $$y(k,n)=x(k,n)+v(k,n), \tag{1}$$

where the vectors x(k,n) and v(k,n) contain the reverberant speech at each microphone and additive noise, respectively.

A. Multichannel Autoregressive Reverberation Model

As proposed in [21, 32, 33], we model the reverberant speech signal vector x(k,n) as an MAR process $$x(k,n)=\underbrace{\sum_{\ell=D}^{L} C_\ell(k,n)x(k,n-\ell)}_{r(k,n)}+s(k,n), \tag{2}$$

where the vector $s(k,n)=[S_1(k,n) \ldots S_M(k,n)]^T$ contains the desired early speech at each microphone $S_m(k,n)$, and the M×M matrices $C_l(k,n)$, $l\in\{D,D+1 \ldots L\}$ contain the MAR coefficients predicting the late reverberation component r(k,n) from past frames of x(k,n). The desired early speech s(k,n) is the innovation in this autoregressive process (also known as the prediction error in the linear prediction terminology). The choice of the delay D≥1 determines, how many early reflections we want to keep in the desired signal, and should be chosen depending on the amount of overlap between STFT frames, such that there is little to no correlation between the direct sound contained in s(k,n) and the late reverberation r(k,n). The length L>D determines the number of past frames that are used to predict the reverberant signal.

We assume that the desired early speech vector $s(k,n)\sim\mathcal{N}(0_{m\times 1},\Phi_s(k,n))$ and the noise vector $v(k,n)\sim\mathcal{N}(0_{M\times 1},\Phi_v(k,n))$ are circularly complex zero-mean Gaussian random variables with the respective covariance matrices $\Phi_s(k,n)=E\{s(k,n)s^H(k,n)\}$ and $\Phi_v(k,n)=E\{v(k,n)v^H(k,n)\}$. Furthermore we assume that s(k,n) and v(k,n) are uncorrelated across time and both variables are mutually uncorrelated.

B. Signal Model Formulated in Two Compact Notations

To formulate a cost-function, which is decomposed into two sub-cost-functions in subsection 3 according to the concept of the present invention, we first introduce two equivalently usable matrix notations to describe the observed signal vector (1). For the sake of a more compact notation, the frequency indices k are omitted in the remainder of the description. Let us first define the quantities $$X(n)=I_M\otimes[x^T(n-L+D) \ldots x^T(n)] \tag{3}$$

$$c(n)=Vec\{[C_L(n) \ldots C_D(n)]^T\}, \tag{4}$$

where $I_M$ is the M×M identity matrix, ⊗ denotes the Kronecker product, and the operator Vec{•} stacks the columns of a matrix sequentially into a vector. Consequently, c(n) is column vector of length $L_c=M^2(L-D+1)$ and X(n) is a sparse matrix of size $M\times L_c$. Using the definitions (3) and (4) with the signal model (1) and (2), the observed signal vector is given by $$y(n)=\underbrace{X(n-D)c(n)}_{r(n)}+\underbrace{s(n)+v(n)}_{u(n)}, \tag{5}$$

where the vector u(n) contains the early speech plus noise signals that consequently have the covariance matrix $\Phi_u(k,n)=E\{u(k,n)u^H(k,n)\}\sim\mathcal{N}(0_{M\times 1},\Phi_u(k,n))$.

The second compact notation uses the stacked vectors $$\underline{x}(n)=[x^T(n-L+1) \ldots x^T(n)]^T \tag{6}$$

$$\underline{s}(n)=[0_{1\times M(L-1)}s^T(n)]^T, \tag{7}$$

indicated as underlined variables, which are column vectors of length ML, and the propagation and observation matrices $$F(n)=\begin{bmatrix} 0_{M(L-1)\times M} & & I_{M(L-1)} & \\ C_L(n) & \ldots & C_D(n) & 0_{M\times M(D-1)} \end{bmatrix} \tag{8}$$

$$H=[0_{M\times M(L-1)}\, I_M], \tag{9}$$

respectively, where the ML×ML propagation matrix F(n) contains the MAR coefficients $C_l(n)$ in the bottom M rows, $0_{A\times B}$ denotes a zero matrix of size A×B, and H is a M×ML selection matrix. Using (8) and (9), we can alternatively recast (2) and (1) to $$\underline{x}(n)=F(n)\underline{x}(n-1)+\underline{s}(n) \tag{10}$$

$$y(n)=H\underline{x}(n)+v(n). \tag{11}$$

Note that (5) and (11) are equivalent using different notations.

C. Stochastic State-Space Modeling of MAR Coefficients

To model possibly time-varying acoustic environments and the non-stationarity of the MAR coefficients due to model errors of the STFT domain model [3], we use a first-order Markov model to describe the MAR coefficient vector [6]

$$c(n)=Ac(n-1)+w(n). \tag{12}$$

We assume that the transition matrix $A=I_{L_c}$ is identity, while the process noise w(n) models the uncertainty of c(n) over time. We assume that $w(n)\sim\mathcal{N}(0_{M\times 1},\Phi_w(n))$ is a circularly complex zero-mean Gaussian random variable with covariance $\Phi_w(n)$, and that w(n) is independent in time and uncorrelated with u(n).

Figure 6:
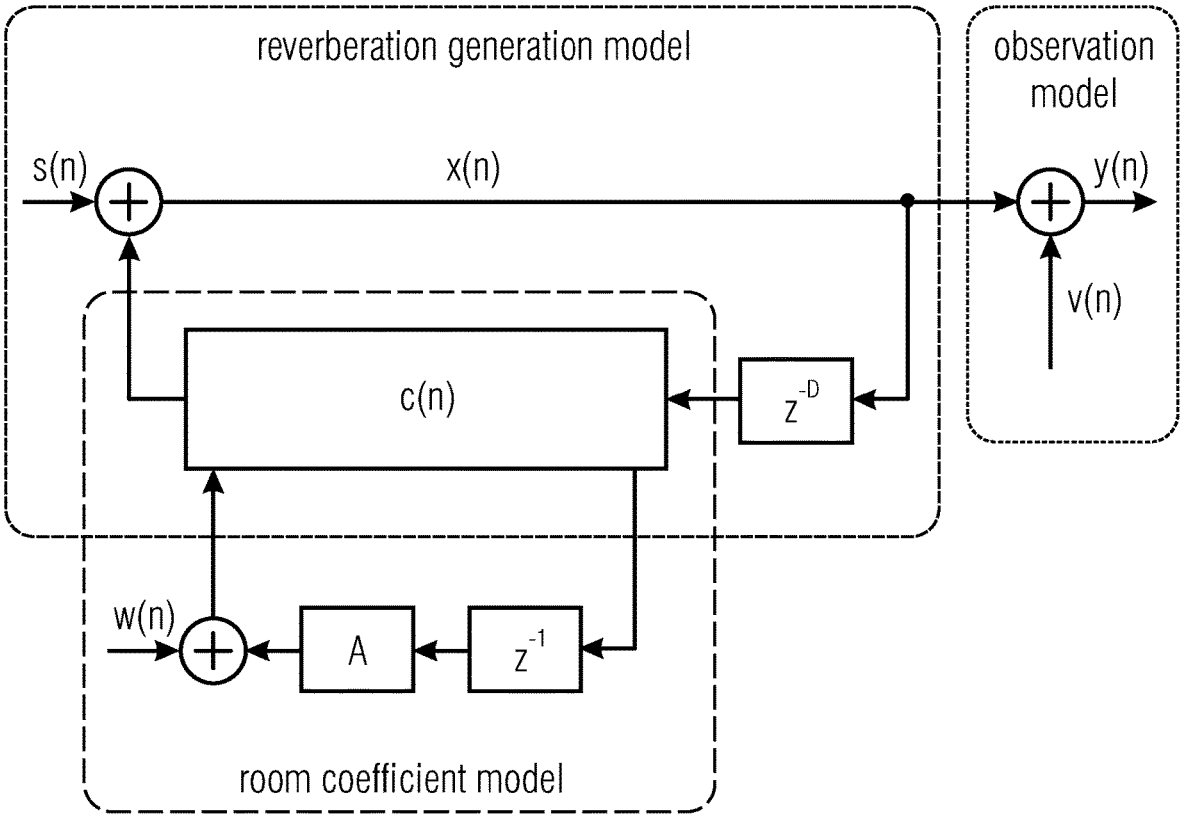
FIG. 6 shows a schematic representation of a generative model of a reverberant signal, of multi-channel autoregressive coefficients and a noisy observation.

FIG. 6 shows the generation process of the observed signals and the underlying (hidden) processes of the reverberant signals and the MAR coefficients.

Taking reference to FIG. 6 it can be seen that the input signal s(n) is overlaid with an output signal of a filter defined by coefficients c(n). Accordingly, a signal x(n) is obtained. The filter having coefficients c(n) receives, as an input signal, the sum of a delayed version of the signal x(n) and the desired early speech signal s(n). The coefficients c(n) of the filter may be time-varying, wherein it is assumed that a previous set of filter coefficients is scaled by a matrix A and affected by a "process noise" w(n).

Furthermore, in the signal model of y(n) is assumed that the background noise signal v(n) is added to the reverberant signal x(n).

However, it should be noted that the generative model of the reverberant signal, of the multi-channel autoregressive coefficients and of the noisy observation as shown in FIG. 6 should be considered as the example only.

D. Problem Formulation

Our goal is to obtain an estimate of the early speech signals s(n). Instead of directly estimating s(n), we propose to first estimate the noise-free reverberant signals x(n) and the MAR coefficients c(n), denoted by $\hat{x}(n)$ and $\hat{c}(n)$. Then we can obtain an estimate of the desired signals by applying the MAR coefficients in the manner of a finite MIMO filter to the reverberant signals, i.e.

$$\hat{s}(n) = \hat{x}(n) - \underbrace{\hat{X}(n-D)\hat{c}(n)}_{\hat{r}(n)}, \tag{13}$$

where $\hat{X}(n)$ is constructed using (3) with $\hat{x}(n)$ and $\hat{r}(n)$ is considered as the estimated late reverberation. In the following subsection we show how we can jointly estimate x(n) and c(n).

3.3 MMSE Estimation by Alternating Minimization

In the following, a concept according to an embodiment of the present invention will be described.

The stacked reverberant speech signal vector $\underline{x}(n)$ and the MAR coefficient vector c(n) (which is encapsulated in F(n)) can be estimated in the MMSE sense by minimizing the cost function $$J(\underline{x}, c) = E\left\{\left\|\underline{x}(n) - \underbrace{\hat{F}^{T}(n)\hat{\underline{x}}(n-1) + \hat{\underline{s}}(n)}_{\hat{\underline{x}}(n)}\right\|_2^2\right\} \tag{14}$$

To simplify, according to an aspect of the invention, the estimation problem (14) to obtain a closed-form solution, we resort to an alternating minimization technique [23], which minimizes the cost function for each variable separately, while keeping the other variable fixed and using the available estimated value. The two sub-cost-functions, where the respective other variable is assumed as fixed, are given by $$J_c(c(n)|\underline{x}(n)) = E\{\|c(n)-\hat{c}(n)\|_2^2\} \tag{15}$$

$$J_x(\underline{x}(n)|c(n)) = E\{\|\underline{x}(n)-\hat{x}(n)\|_2^2\}. \tag{16}$$

Note that to solve (15) at frame n, it is sufficient to know the delayed stacked vector $\underline{x}(n-D)$ to construct X(n−D), since the signal model (5) at time frame n depends only on past values of x(n) with D≥1. Therefore we can state for the given signal model $J_c(c(n)|\underline{x}(n)) = J_c(c(n)|\underline{x}(n-D))$.

By replacing the deterministic dependencies of the cost functions (15) and (16) on $\underline{x}(n)$ and c(n) by the available estimates, we naturally arrive at the alternating minimization procedure for each time step n:

$$1)\ \hat{c}(n) = \underset{c}{\operatorname{argmin}} J_c(c(n) \mid \hat{\underline{x}}(n-D)) \tag{17}$$

$$2)\ \hat{\underline{x}}(n) = \underset{\underline{x}}{\operatorname{argmin}} J_x(\underline{x}(n) \mid \hat{c}(n)) \tag{18}$$

The ordering of solving (17) before (18), in some embodiments, is, in some embodiments, especially important if the coefficients c(n) are time-varying. Although convergence of the global cost function (14) to the global minimum is not guaranteed, it converges to local minima if (15) and (16) decrease individually. For the given signal model, (15) and (16) can be solved using the Kalman filter [14].

The resulting procedure (or concept) to estimate the desired signal vector s(n) by (13) results in the following three steps, which are also outlined in FIG. 7:

1. Estimate the MAR coefficients c(n) from the noisy observed signals (for example, y(n)) and delayed noise-free signals x(n') for n'∈{1, n−1, . . . , n−D}, which are assumed to be deterministic and known. In practice, these signals are replaced by the estimates $\underline{x}(n')$ obtained from the second Kalman filter in Step 2.
2. Estimate the reverberant microphone signals $\underline{x}(n)$ by exploiting the autoregressive model. This step is considered as noise reduction stage. Here, the MAR coefficients c(n) are assumed to be deterministic and known. In practice, the MAR coefficients are obtained as the estimate $\hat{c}(n)$ from Step 1. The obtained Kalman filter is similar to the Kalman smoother used in [30].
3. From the estimated MAR coefficients e(n) and from delayed versions of the noise-free signals $\hat{x}(n)$, the estimate $\hat{r}(n)$ of the late reverberation r(n) can be obtained. The desired signal $\hat{s}(n)$ is then obtained by subtracting the estimated reverberation from the noise-free signal using (13). (optional)

Figure 7:
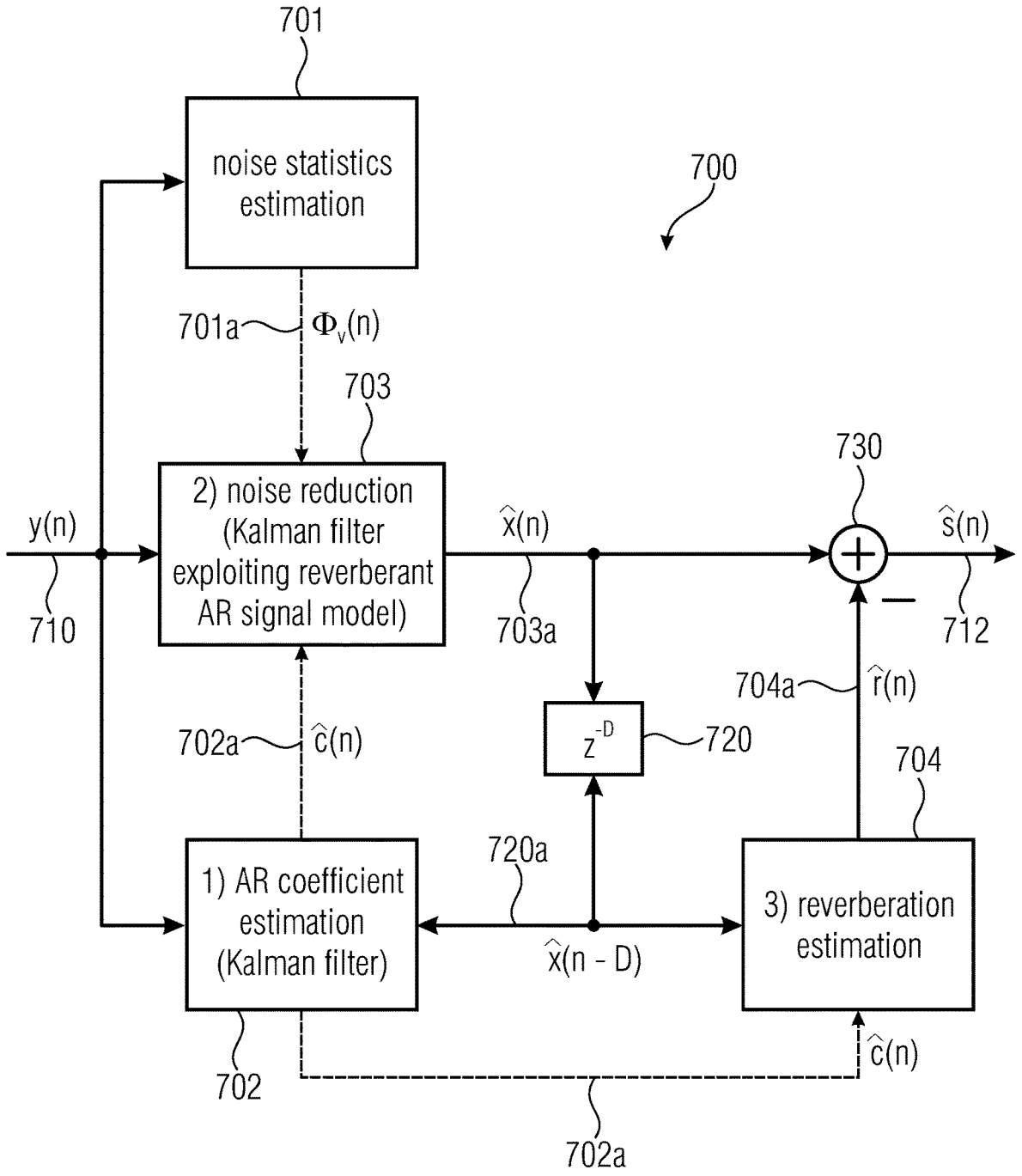
FIG. 7 shows a block schematic diagram of an apparatus (or signal processor) comprising a proposed parallel dual Kalman filter structure, according to an embodiment of the present invention.

The noise reduction stage, in some cases, needs the second-order noise statistics as indicated by the grey estimation block in FIG. 7. As there exist sophisticated methods to estimate second-order noise statistics, e.g., [9, 19, 28]. In the following, we assume the noise statistics to be known.

In the following, a possible simple embodiment and some optional details will be described taking reference to FIG. 7, which shows a block schematic diagram of a proposed parallel dual Kalman filter structure (according to an embodiment of the invention). It should be noted here that the three-step procedure as shown in FIG. 7 ensures that all blocks receive current parameter estimates without delay at each time step n. For the grey noise estimation block (for example, for the noise statistics estimation) several suitable solutions exist which are beyond the scope of the present application.

As can be seen, the signal processor or apparatus 700 according to FIG. 7 comprises a noise statistics estimation 701, an AR coefficient estimation 702 (which may, for example, comprise or use a Kalman filter) and a noise reduction 703 which may, for example, comprise or use a Kalman filter exploiting a reverberant AR signal model. Moreover, the apparatus 700 comprises a reverberation estimation 704. The apparatus 700 is configured to receive an input signal 710 and to provide an output signal 712.

For example, the noise statistics estimation 701 may receive the input signal 710 and provide, on the basis thereof, a noise statistics information **701*a*** which can also be designated with $\phi_v(n)$ (for example, according to step 3 of "Algorithm 1").

The AR coefficient estimation 702 may, for example, receive the input signal 710 and also a delayed version of a noise-reduced (and typically reverberant) signal **720*a* which may, for example, be designated with $\hat{x}(n-D)$ (or which may be represented by $\hat{X}(n-D)$). For example, the AR coefficient estimation 702 will perform the estimation of the MAR coefficients c(n) from the noisy observed signals (for example, y(n)) and delayed noise-reduced (or noise-free) signals $\hat{x}(n-D)$). For example, the AR coefficient estimation 702 may be configured to perform the functionality as defined by equations (20) to (25) and/or according to steps 4 to 6 of "Algorithm 1", wherein the AR coefficient estimation filter 702** may also obtain an estimate of a covariance of an uncertainty $\phi_w(n)$ and a covariance $\phi_u(n)$.

The noise reduction 703 receives the input signal 710, the noise statistics information 701*a* and the estimated MAR coefficient information 702*a* (also designated with $\hat{c}(n)$). Also, the noise reduction 703 may, for example, provide an estimate of a noise reduced (but typically reverberant) signal 703*a* which is also designated with $\hat{x}(n)$. For example, the noise reduction 703 may perform the functionality as defined by equations (31) to (36), and/or according to steps 7 to 9 of "algorithm 1". Moreover, it should be noted that steps 4 to 6 of "algorithm 1" may be performed by the AR coefficient estimation 702.

Moreover, it should be noted that a delay block 720 may derive the delayed version 720*a* from the noise reduced signal 703*a*.

A reverberation estimation 704 may derive a reverberation signal 704*a* (which is also designated with $\hat{r}(n)$ from the delayed version of the noise reduced signal 720*a*, taking into consideration the MAR coefficients 702*a*. For example, the reverberation estimation 704 may estimate the reverberation signal 704*a* as shown in equation (13).

A subtractor 730 may subtract the estimated reverberation signal 704*a* from the noise reduced signal 703*a*, for example as shown in equation (13). Accordingly, the output signal 712 (also designated with § (n)) is obtained.

Thus, the reverberation estimator and the subtractor may, for example, perform step 10 of "Algorithm 1".

Regarding the functionality of the apparatus 700, it should be noted that the apparatus 700 can, alternatively, use different concepts for the estimation of the noise reduced signal 703 and for the estimation of the MAR coefficients 702.

On the other hand, the apparatus 700 can be supplemented by any of the features, functionalities and details described herein, for example, with respect to the Kalman filtering and/or with respect to the estimation of statistic parameters, like $\phi_u(n)$, $\phi_w(n)$, $\phi_s(n)$, $\phi_v(n)$.

However, it should be noted that any of the details described with reference to FIG. 7 should be considered as being optional.

Figure 8:
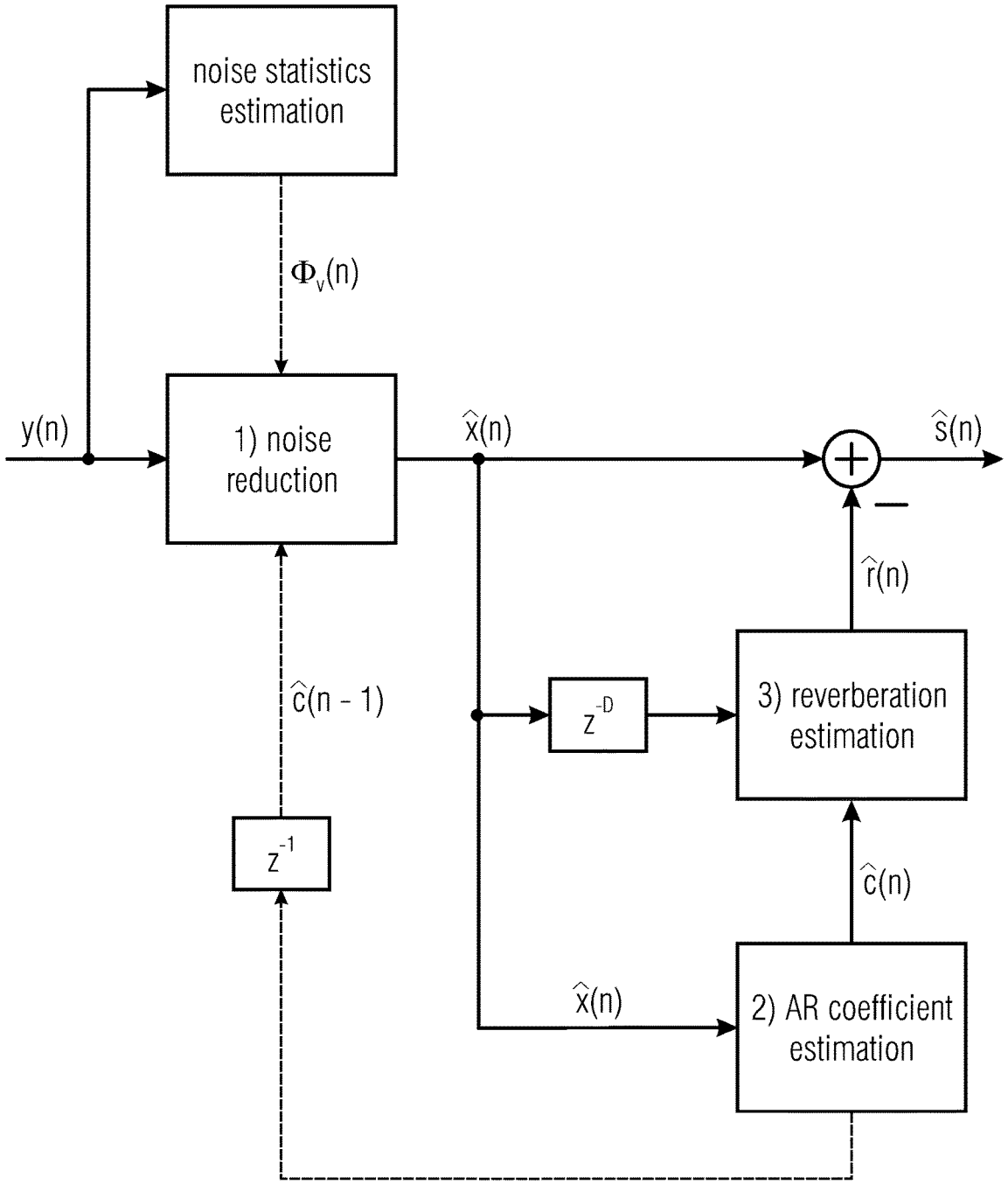
FIG. 8 shows a block schematic diagram of a conventional sequential noise reduction and dereverberation structure according to reference [31]

The proposed structure overcomes the causality problem of commonly used sequential structures for AR signal and parameter estimation [8], [31], where each estimation step needs a current estimate from each other. Such conventional sequential structures are illustrated in FIG. 8 for the given signal model, where in this case the noise reduction stage would receive delayed MAR coefficients. This would be suboptimal in the case of time-varying coefficients c(n).

In contrast to related state-parameter estimation methods [8], [17], our desired signal is not the state variable but a signal obtained from both state estimates (13).

In the following, additional (optional) details regarding the estimation of MAR coefficients and regarding the noise reduction will be described. Also, some details regarding the estimation of parameters will be described. However, it should be noted that all of these details should be considered as being optional. The details can optionally be added to the embodiments described herein and defined in the claims, both individually and in combination.

A Optimal Sequential Estimation of MAR Coefficients

Given knowledge of the delayed reverberant signals x(n) that are estimated as shown in FIG. 7, we derive a Kalman filter to estimate the MAR coefficients in this subsection.

1) Kalman filter for MAR Coefficient Estimation

Let us assume, we have knowledge of the past reverberant signals contained in the matrix X(n−D). In the following, we consider (12) and (5) as state and observation equations, respectively. Given that w(n) and u(n) are zero-mean Gaussian noise processes, which are mutually uncorrelated, we can obtain an optimal sequential estimate of the MAR coefficient vector by minimizing the trace of the error matrix $$\Phi_{\Delta c}(n)=E\{[c(n)-\hat{c}(n)][c(n)-\hat{c}(n)]^H\}. \tag{19}$$

The solution is obtained, for example, using the well-known Kalman filter equations [3, 14]

$$\hat{\Phi}_{\Delta c}(n|n-1)=A\hat{\Phi}_{\Delta c}(n-1)A^H+\Phi_w(n) \tag{20}$$

$$\hat{c}(n|n-1)=A\hat{c}(n-1) \tag{21}$$

$$e(n)=y(n)-X(n-D)\hat{c}(n|n-1) \tag{22}$$

$$K(n)=\hat{\Phi}_{\Delta c}(n|n-1)X^H(n-D) \tag{23}$$

$$[X(n-D)\hat{\Phi}_{\Delta c}(n|n-1)X^H(n-D)+\Phi_u(n)]^{-1}$$

$$\hat{\Phi}_{\Delta c}(n)=[I_{L_c}-K(n)X(n-D)]\hat{\Phi}_{\Delta c}(n|n-1) \tag{24}$$

$$\hat{c}(n)=\hat{c}(n|n-1)+K(n)e(n), \tag{25}$$

where K(n) is called the Kalman gain and e(n) is the prediction error. Note that the prediction error is an estimate of the early speech plus noise vector u(n) using the predicted MAR coefficients, i.e. e(n)=u(n|n−1).

2) Parameter Estimation

The matrix X(n−D) containing only delayed frames of the reverberant signals x(n) is estimated using the second Kalman filter described in subsection 3.B.

We assume $A=I_{L_c}$ and the covariance of the uncertainty noise $\Phi_w(n)=\phi_w(n)I_{L_c}$, where we propose to estimate the scalar variance $\phi_w(n)$ by [6]

$$\hat{\phi}_w(n)=\frac{1}{L_c}\|\hat{c}(n)-\hat{c}(n-1)\|_2^2+\eta, \tag{26}$$

and η is a small positive number to model the continuous variability of the MAR coefficients if the difference between subsequent estimated coefficients is zero.

The covariance $\Phi_u(n)$ can be estimated in the ML sense as proposed in [3] given the p.d.f. $f(y(n)|\hat{\Theta}(n))$, where $\hat{\Theta}(n)=\{\hat{x}(n-L), \ldots, \hat{x}(n-1), \hat{c}(n)\}$ are the currently available parameter estimates at frame n. By assuming stationarity of $\Phi_u(n)$ within N frames, the ML estimate given the currently available information is obtained by $$\hat{\Phi}_u^{ML}(n)=\frac{1}{N}\left(\Sigma_{\ell=n-N+1}^{n-1}\hat{u}(n-\ell)\hat{u}^H(n-\ell)+e(n)e^H(n)\right), \tag{27}$$

where $\hat{u}(n)=y(n)-\hat{X}(n-D)\hat{c}(n)$ and e(n)=u(n|n−1) is the predicted speech plus noise signal, since $\hat{c}(n)$ is not yet available.

In practice, the arithmetic average in (27) can be replaced by a recursive average, yielding the recursive estimate $$\hat{\Phi}_u(n)=\alpha\hat{\Phi}_u^R(n-1)+(1-\alpha)e(n)e^H(n), \tag{28}$$

where the recursive covariance estimate, which can be computed only for the previous frame, is obtained by $$\hat{\Phi}_u^R(n)=\alpha\hat{\Phi}_u^R(n-1)+(1-\alpha)\hat{u}(n)\hat{u}^H(n), \tag{29}$$

and α is a recursive averaging factor.

B. Optimal Sequential Noise Reduction

Given knowledge of the current MAR coefficients c(n) that are estimated as shown in FIG. 7, we derive a second Kalman filter to estimate the noise-free reverberant signal vector $\underline{x}(n)$ in this subsection.

1) Kalman Filter for Noise Reduction

By assuming the MAR coefficients c(n), respectively the matrix F(n), as given, and by considering the stacked reverberant signal vector $\underline{x}(n)$ containing the latest L frames of x(n) as state variable, we consider (10) and (11) as state and observation equations. Due to the assumptions on s(n) and (7), $\underline{s}(n)$ is also a zero-mean Gaussian random variable and its covariance matrix $\Phi_{\underline{s}}(n)=E\{\underline{s}(n)\underline{s}^H(n)\}$ contains $\Phi_s(n)$ in the lower right corner and is zero elsewhere.

Given that $\underline{s}(n)$ and v(n) are zero-mean Gaussian noise processes, which are mutually uncorrelated, we can obtain an optimal sequential estimate of $\underline{x}(n)$ by minimizing the trace of the error matrix $$\Phi_{\Delta x}(n)=E\{[\underline{x}(n)-\hat{\underline{x}}(n)][\underline{x}(n)-\hat{\underline{x}}(n)]^H\}. \tag{30}$$

The standard Kalman filtering equations to estimate the state vector x(n) are given by the predictions $$\hat{\Phi}_{\Delta x}(n|n-1)=F(n)\hat{\Phi}_{\Delta x}(n-1)F^H(n)+\Phi_{\underline{s}}(n) \tag{31}$$

$$\hat{\underline{x}}(n|n-1)=F(n)\hat{\underline{x}}(n-1) \tag{32}$$

and updates $$K_x(n)=\hat{\Phi}_{\Delta x}(n|n-1)H^H\times[H\hat{\Phi}_{\Delta x}(n|n-1)H^H+\Phi_v(n)]^{-1} \tag{33}$$

$$e_x(n)=y(n)-H\hat{\underline{x}}(n|n-1) \tag{34}$$

$$\hat{\Phi}_{\Delta x}(n)=[I_{ML}-K_x(n)H]\hat{\Phi}_{\Delta x}(n|n-1), \tag{35}$$

$$\hat{\underline{x}}(n)=\hat{\underline{x}}(n|n-1)+K_x(n)e_x(n) \tag{36}$$

where $K_x(n)$ and $e_x(n)$ are the Kalman gain and the prediction error of the noise reduction Kalman filter.

The estimated noise-free reverberant signal vector at frame n is contained in the state vector and given by $\hat{x}(n)=H\hat{\underline{x}}(n)$.

2) Parameter Estimation

The noise covariance matrix $\Phi_v(n)$ is assumed to be known. For stationary noise, it can be estimated from the microphone signals during speech absence e. g. using the methods proposed in [9, 19, 28].

Further, we should estimate $\Phi_s(n)$, i.e. the desired speech covariance matrix $\Phi_s(n)$. To reduce musical tones arising from the noise reduction procedure performed by the Kalman filter, we use a decision-directed approach [7] to estimate the current speech covariance matrix $\Phi_s(n)$, which is in this case a weighting between the a-posteriori estimate $\hat{\Phi}_s^{pos}(n)=E\{\Phi_s(n)|\hat{s}(n)\}$ at the previous frame and the a-priori estimate $\hat{\Phi}_s^{pri}(n)=E\{\Phi_s(n)|y(n),\hat{r}(n)\}$ at the current frame. The decision-directed estimate is given by $$\hat{\Phi}_s(n)=\gamma\hat{\Phi}_s^{pos}(n-1)+(1-\gamma)\hat{\Phi}_s^{pri}(n), \tag{37}$$

where γ is the decision-directed weighting parameter. To reduce musical tones, the parameter is typically chosen to put more weight on the previous a-posteriori estimate.

The recursive a-posteriori ML estimate is obtained by $$\hat{\Phi}_s^{pos}(n)=\alpha\hat{\Phi}_s^{pos}(n-1)+(1-\alpha)\hat{s}(n)\hat{s}^H(n), \tag{38}$$

where α is a recursive averaging factor.

To obtain the a-priori estimate $\hat{\Phi}_s^{pri}(n)$, we derive a MWF, i.e.

$$W_{MWF}(n)=\underset{W}{\operatorname{argmin}}E\{\|s(n)-W^H y(n)\|_2^2\}. \tag{39}$$

By inserting (10) in (11), we can rewrite the observed signal vector as $$y(n)=s(n)+\underbrace{HF(n)\underline{x}(n-1)}_{r(n)}+v(n), \tag{40}$$

where all three components are mutually uncorrelated. Note that estimates of all components of the late reverberation r(n) are already available at this point. An instantaneous estimate of $\Phi_s(n)$ using an MMSE estimator given the currently available information is then obtained by $$\hat{\Phi}_s^{pri}(n)=W_{MWF}^H(n)y(n)y^H(n)W_{MWF}(n) \tag{41}$$

The MWF filter matrix is given by $$W_{MWF}(n)=\Phi_y^{-1}(n)[\Phi_y(n)-\Phi_r(n)-\Phi_v(n)], \tag{42}$$

where $\Phi_y(n)$ and $\Phi_r(n)$ are estimated using recursive averaging from the signals y(n) and $\hat{r}(n)$, similar to (38).

C. Algorithm Overview

An example of the complete algorithm is outlined in the following "Algorithm 1".

Algorithm 1: Proposed algorithm per frequency band k

```
Initialize: ĉ(0) = 0, x̂(0) = 0, Φ̂_Δc(n) = I_Lc, Φ̂_Δx(n) = I_ML
for each n do
    Estimate the noise covariance Φ_v(n), e.g. using [9]
    X(n − D) ← x̂(n − 1)
    Compute Φ̂_w(n) = φ_w(n)I_Lc using (26)
    Obtain ĉ(n) using (37) by calculating (20)-(22), (27), (23)-(25)
    F(n) ← ĉ(n)
    Φ_s(n) ← Φ̂_s(n) using (37)
    Obtain x(n) by calculating (32)-(35)
    Estimate the desired signal by (13)
end for
```

The initialization of the Kalman filters is uncritical. The initial convergence phase could be improved if good initial estimates of the state variables are available, but the algorithm converged and stayed stable in practice.

Although the proposed algorithm is perfectly suitable for real-time processing applications, the computational complexity is quite high. The complexity depends on the number of microphones M and filter length L per frequency and the number of frequency bands.

3.4. Reduction Control

In some applications it is beneficial to have independent control over the reduction of the undesired sound components such as reverberation and noise. Therefore, we show how to (optionally) compute an alternative output signal z(n), where we have control over the reduction of reverberation and noise. In other words, the functionalities described in this subsection may be considered as being optional.

The desired controlled output signal is given by $$z(n)=s(n)+\beta_r(n)+\beta_v v(n), \tag{43}$$

where $\beta_r$ and $\beta_v$ are attenuation factors of the reverberation and noise. By re-arranging (43) using (5) and replacing unknown variables by the available estimates, we can compute the desired controlled output signals by $$\hat{z}(n)=\beta_v y(n)+(1-\beta_v)\hat{x}(n)-(1-\beta_r)\hat{r}(n). \tag{44}$$

Note that for $\beta_v=\beta_r=0$, the output $\hat{z}(n)$ is identical to the early speech estimate $\hat{s}(n)$, and for $\beta_v=\beta_r=1$, the output $\hat{z}(n)$ is equal to y(n).

Typically, speech enhancement algorithms have a trade-off between the amount of interference reduction and artifacts such as speech distortion or musical tones. To reduce audible artifacts in periods where the MAR coefficient estimation Kalman filter is adapting fast and exhibits a high prediction error, we optionally use the estimated error covariance matrix $\hat{\Phi}_{\Delta c}(n)$ given by (24) to adaptively control the reverberation attenuation factor $\beta_r$. If the error of the Kalman filter is high, we like the attenuation factor $\beta_r$ to be close to one. For example, we propose to compute the reverberation attenuation factor at time frame n by the heuristically chosen mapping function $$\beta_r(n) = \max\left\{\frac{1}{1+\mu_r L_c tr\{\Phi_{\Delta c}(n)\}^{-1}},\ \beta_{r,min}\right\}, \tag{45}$$

where the fixed lower bound $\beta_{r,min}$ limits the allowed reverberation attenuation, and the factor $\mu_r$ controls the attenuation depending on the Kalman error.

Figure 9:
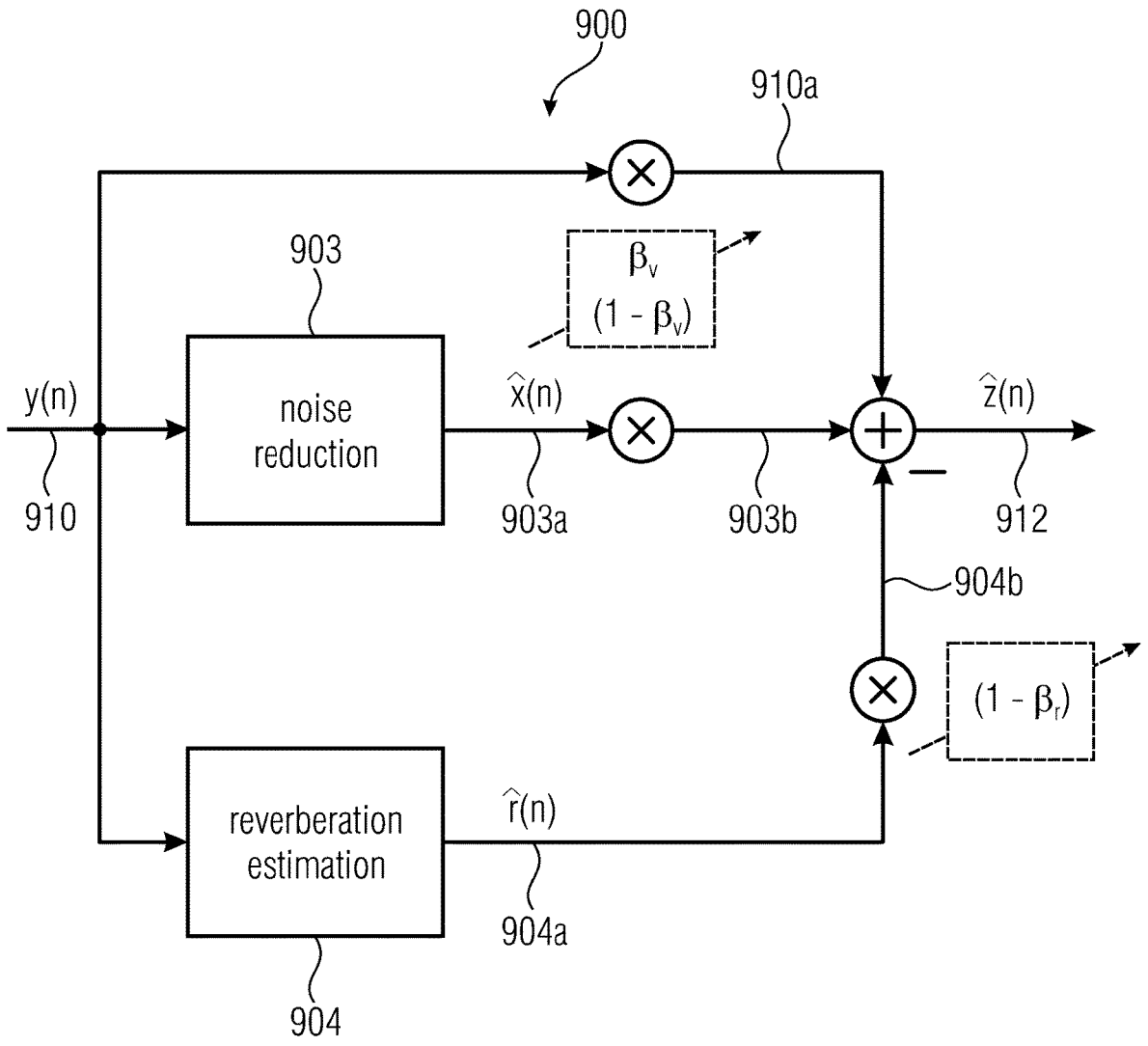
FIG. 9 shows a block schematic diagram of a proposed structure to control an amount of noise reduction $\beta_v$ and reverberation reduction $\beta_r$.

The structure of the proposed system with reduction control is illustrated in FIG. 9. The noise estimation block is omitted here as it can be also integrated in the noise reduction block.

In other words, FIG. 9 shows an apparatus or signal processor 900 according to an embodiment of the invention. The apparatus 900 is configured to receive an input signal 910 and to provide, on the basis thereof, a processed signal or output signal 912. The apparatus comprises a noise reduction 903 and a reverberation estimation 904. Moreover, it should be noted that the noise reduction 903 may provide a noise reduced signal 903*a*, which may be scaled by a scaling factor of $(1-\beta_v)$, to obtain a scaled version 903*b* of the noise reduced signal 903*a*. Similarly, the reverberation estimation 904 may be configured to provide an (estimated) reverberation signal 904*a*, which may be scaled, for example, by a scaling factor of $(1-\beta_r)$, to obtain a scaled reverberation signal 904*b*. Moreover, the input signal 910 is scaled, for example, by a scaling factor of $\beta_v$ to obtain a scaled input signal. Moreover, the scaled input signal, the scaled noise reduced signal 903*b* and the scaled reverberation signal 904*b* are combined to thereby obtain the output signal 912, wherein the scaled reverberation signal 904 may, for example, be subtracted from the sum of the scaled input signal 910*a* and the scaled noise reduced signal 903*b*.

It should be noted that the functionality of the apparatus 900 may be similar to the functionality of the apparatus 400 described above. Accordingly, the input signal 910 may correspond to the input signal 410, the output signal 912 may correspond to the output signal 412, the noise reduction 903 may correspond to the noise reduction 303, the reverberation estimation 904 may correspond to the reverberation estimation 304, the scaled input signal 910*a* may correspond to the scaled input signal 410*a*, the noise reduced signal 903*a* may correspond to the noise reduced signal 303*a*, the scaled noise reduced signal 903*b* may correspond to the scaled noise reduced signal 303*b*, the reverberation signal 904*a* may correspond to the reverberation signal 304*a* and the scaled reverberation signal 904*b* may correspond to the scaled reverberation signal 304*b*.

Also, the overall functionality of the apparatus 900 may be similar to the overall functionality of the apparatus 400, unless differences are mentioned here.

The noise reduction 903 may, for example, comprise the functionality of the noise reduction 703. The reverberation estimation may, for example, comprise the functionality of the reverberation estimation 704, for example, when taken in combination with the AR coefficient estimation 702 and the delayer 720. Moreover, the noise reduction 903 may, for example, receive noise statistics information, like the noise statistics information 701 and may also receive estimated AR coefficients or MAR coefficients, like the coefficients 702*a*.

Accordingly, it is possible to adjust the characteristics of the output signal 912, for example, by setting the parameters $\beta_v$ and $\beta_r$.

Optionally, the parameter $\beta_r$ can be time-variant and can be computed, for example, in accordance with equation (45).

3.5 Evaluation

In this subsection, we evaluate the proposed system using the experimental setup described in subsection 3.5-A by comparing to the two reference methods reviewed in subsection 3.5-B. The results are shown in subsection 3.5-C.

A. Experimental Setup (Optional)

The reverberant signals were generated by convolving RIRs (room impulse responses) with anechoic speech signals from [5]. We used two different kinds of RIR: measured RIRs in an acoustic lab with variable acoustics at Bar-Ilan University, Israel, or simulated RIRs using the image method [1] for moving sources. In the case of moving sources, the simulated RIRs facilitate the evaluation, as in this case it is possible to additionally generate RIRs containing only direct sound and early reflections to obtain the target signal for evaluation.

In simulated and measured cases, we used a linear microphone array with up to M=4 omnidirectional microphones with inter-microphone spacings {11, 7, 14} cm. Note that in all experiments experiments except in subsection 3.5-C1, only 2 microphones with spacing 11 cm are used. Either stationary pink noise or recorded babble noise was added to the reverberant signals with a certain iSNR (input signal-to-noise ratio). We used a sampling frequency of 16 kHz and the STFT parameters were a square-root Hann window of 32 ms length, 50% overlap and a FFT length of 1024 samples. The delay depending on the overlap was set to D=2. The recursive averaging factor was $$\alpha = e^{-\frac{\Delta f}{\tau}}$$

with $\tau$=25 ms, where $\Delta t$=16 ms is the frame shift, the decision-directed weighting factor was $\gamma$=0.98 and we chose $\eta=10^{-4}$. We present results without RC, i.e. $\beta_v=\beta_r=0$, and with RC using different settings for $\beta_v$ and $\beta_{r,min}$, where we chose $\mu_r$=10 dB in (45).

For evaluation, the target signals were generated as the direct speech signal with early reflections up to 32 ms after the direct sound peak (corresponds to a delay of D=2 frames). The processed signals are evaluated in terms of the cepstral distance (CD) [16], the perceptual evaluation of speech quality (PESQ) [11], the frequency-weighted segmental signal-to-interference ratio (fwSSIR) [18], where reverberation and noise are considered as interference, and the normalized speech-to-reverberation modulation ratio (SRMR) [24]. These measures have been shown to yield reasonable correlation with the perceived amount of reverberation and overall quality in the context of dereverberation [10, 15]. The CD reflects more the overall quality and is sensitive to speech distortion, while PESQ, SIR and SRMR are more sensitive to reverberation/interference reduction.

We present only results for the first microphone as all other microphones show the same behavior.

B Reference Methods (Optional)

To show the effectiveness and performance of the proposed method (dual-Kalman), we compare it to the following two methods:

- single-Kalman: A single Kalman filter to estimate the MAR coefficients without noise reduction as proposed in [3]. The original algorithm assumes no additive noise. However, it can be still used to estimate the MAR coefficients from the noisy signal and then obtain a dereverberated, but still noisy filtered signal as output.
- MAP-EM: In the method proposed in [31], the MAR coefficients are estimated using a Bayesian approach based on MAP estimation and the noise-free desired signal is then estimated using an EM algorithm. The algorithm is online, but the EM procedure needs about 20 iterations per frame to converge.

C. Results

Figure 10:
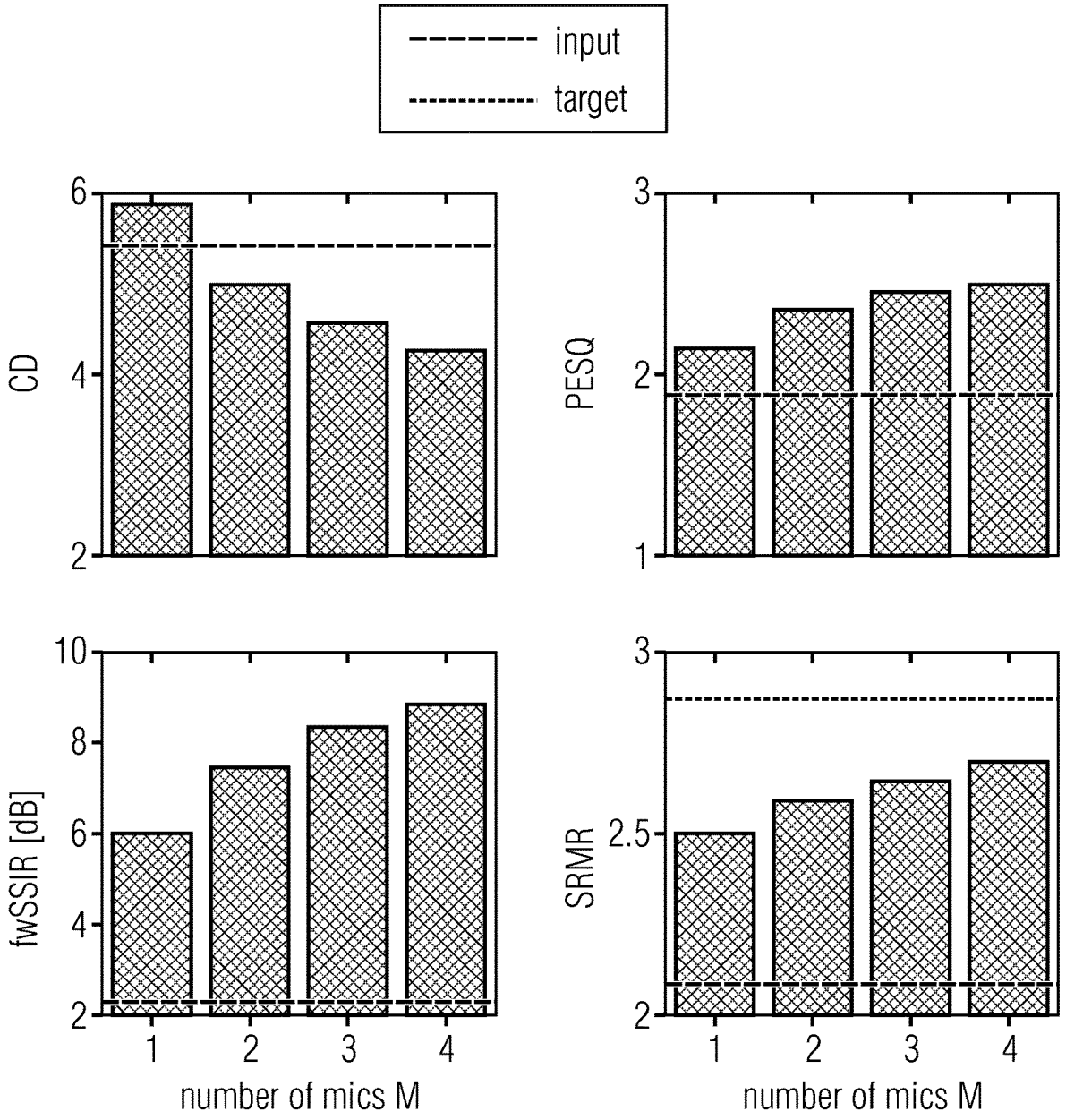
FIG. 10 shows a schematic representation of objective measures for varying microphone number using measured RIRs, iSNR=10 dB, L=15, no reduction control ($\beta_v=\beta_r=0$)

1) Dependence on number of microphones: We investigated the performance of the proposed algorithm depending on the number of microphones M. The desired signal with a total length of 34 s consisted of two non-concurrent speakers at different positions: During the first 15 s the first speaker was active, while after 15 s, the second speaker was active. Each speaker signal was convolved with measured RIRs at different positions with with a $T_{60}$=630 ms. Stationary pink noise was added to the reverberant signals with iSNR=15 dB. FIG. 10 shows CD, PESQ, SIR and SRMR for a varying number of microphones M. The measures for the noisy reverberant input signal are indicated as light grey dashed line, and the SRMR of the target signal, i.e. the early speech, is indicated as dark grey dash-dotted line. For M=1, the CD is larger than for the input signal, which indicates an overall quality deterioration, whereas PESQ, SIR and SRMR still improve over the input, i.e. reverberation and noise are reduced. The performance in terms of all measures increases by increasing the number of microphones.

2) Dependence on Filter Length

Figure 11:
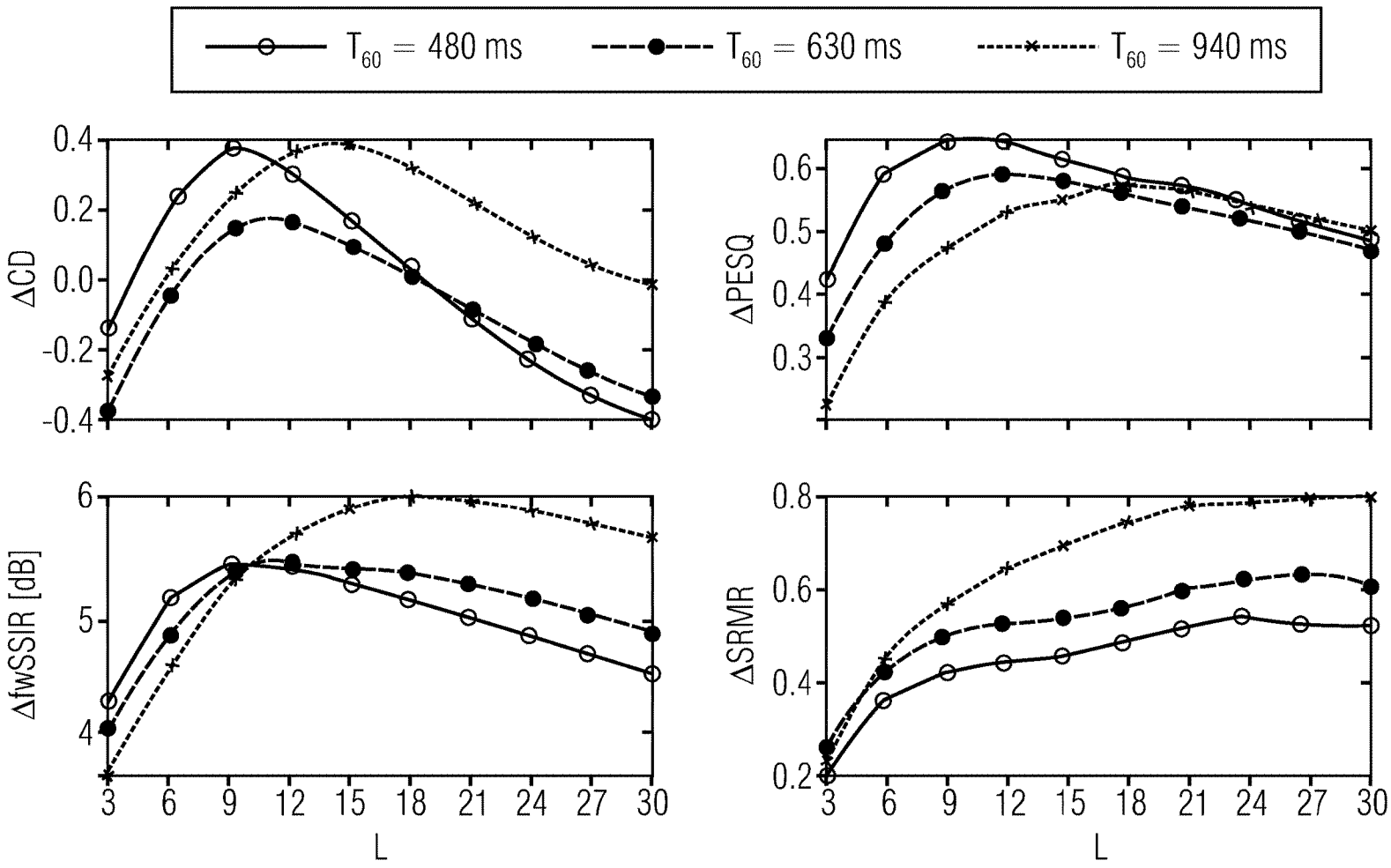
FIG. 11 shows a graphic representation of objective measures for varying filter length L, parameters iSNR=15 dB, M=2, no reduction control ($\beta_v=\beta_r=0$)

The effect of the filter length L was investigated using measured RIR with different reverberation times. As in the first experiment, two non-concurrent speakers were active at different positions, and stationary pink noise was added with iSNR=15 dB. FIG. 11 shows the improvement of the objective measures compared to the unprocessed microphone signal. Positive values indicate an improvement for all relative measures, where Δ denotes the improvement. Considering the given STFT parameters, the reverberation times $T_{60}$={480,630,940} s correspond to filter lengths L={30,39, 58} frames. We can observe that the best CD, PESQ and SIR values depend on the reverberation time, but the optimal values are obtained at around 25% of the corresponding length of the reverberation time. In contrast, the SRMR monotonously grows with increasing L. It is worthwhile to note that the reverberation reduction becomes more aggressive with increasing L. If the reduction is too aggressive by choosing L too large, the desired speech is distorted as the ACD indicates with negative values.

3) Comparison with Conventional Methods

The proposed algorithm and the two reference algorithms were evaluated for two noise types in varying iSNRs. As in the first experiments, the desired signal consisted of two concurrent speakers at different positions with a total length of 34 s using measured RIRs with $T_{60}$=630 ms. Either stationary pink noise or recorded babble noise was added with varying iSNR. Tables 1 and 2 show the improvement of the objective measures compared to the unprocessed microphone signal in stationary pink noise and in babble noise, respectively. Note that although the babble noise is not short-term stationary, we used a stationary long-term estimate of the noise covariance matrix, which is realistic to obtain as an estimate in practice.

It can be observed that the proposed algorithm either without or with RC outperforms both competing algorithms in all conditions. The RC provides a trade-off between interference reduction and desired signal distortion. The CD as an indicator for speech distortion is consistently better with RC, whereas the other measures, which majorly reflect the amount of interference reduction, consistently achieve slightly higher results without RC in stationary noise. In babble noise, the dual-Kalman with RC yields higher PESQ at low iSNR than without RC. This indicates that the RC can help to improve the quality by masking artifacts in challenging iSNR conditions and in the presence of noise covariance estimation errors. In high iSNR conditions, the performance of the dual-Kalman becomes similar to the performance of the single-Kalman as expected.

4) Tracking of Moving Speakers

A moving source was simulated using simulated RIRs in a shoebox room with $T_{60}$=500 ms based on the image method [1, 36]: The desired source was first at position A, and during the time interval [8, 13] s it moved continuously from position A to B, where it stayed then for the rest of the time. Position A and B were 2 m apart.

Figure 12:
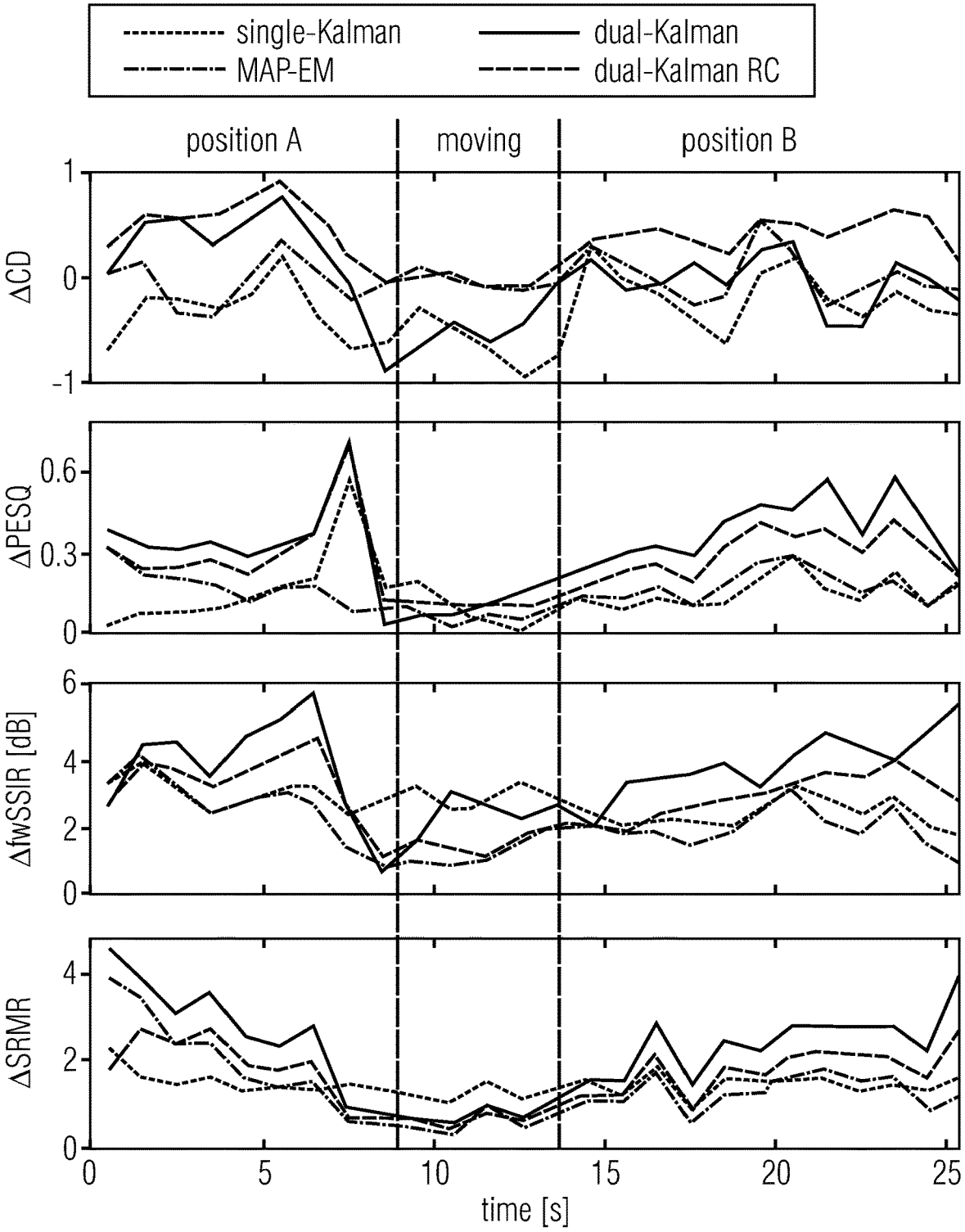
FIG. 12 shows a graphic representation of short-term measures for a moving source between 8-13 s in a simulated shoebox room with $T_{60}$=500 ms, iSNR=15 dB, M=2, L=15, $\beta_v$=−15 dB, $\beta_{r,\ min}$=−15 dB.

FIG. 12 shows the segmental improvement of CD, PESQ, SIR and SRMR for this dynamic scenario. In this experiment, the target signal for evaluation is generated by simulating the wall reflections only up to the second order.

We observe that all measures decrease during the movement, while after the speaker has reached position B, the measures reach high improvements again. The convergence of all methods behaves similar, while the dual-Kalman without and with RC perform best. During the moving time period, the MAP-EM yields sometimes higher fwSSIR and SRMR, but at the price of much worse CD and PESQ. The reduction control improves the CD, such that the CD improvement stays positive, which indicates that the RC can reduce speech distortion and artifacts. It is worthwhile to note that even if the reverberation reduction can become less effective during movement of the speech source, the dual-Kalman algorithm did not become unstable, and the improvements of PESQ, SIR and SRMR were positive, and the ICD was positive by using the RC. This was also verified using real recordings with moving speakers.

5) Evaluation of Reduction Control

In this subsection, we evaluate the performance of the RC in terms of the reduction of noise and reverberation by the proposed system. In the appendix it is shown how the residual noise and reverberation signals after processing with RC $z_v(n)$ and $z_r(n)$ for the proposed dual-Kalman filter system can be computed. The noise reduction and reverberation reduction measures are then computed by $$NR(n) = \frac{\Sigma_k \|z_v(k,n)\|_2^2}{\Sigma_k \|v(k,n)\|_2^2} \tag{46}$$

$$RR(n) = \frac{\Sigma_k \|z_r(k,n)\|_2^2}{\Sigma_k \|r(k,n)\|_2^2}. \tag{47}$$

Figure 13:
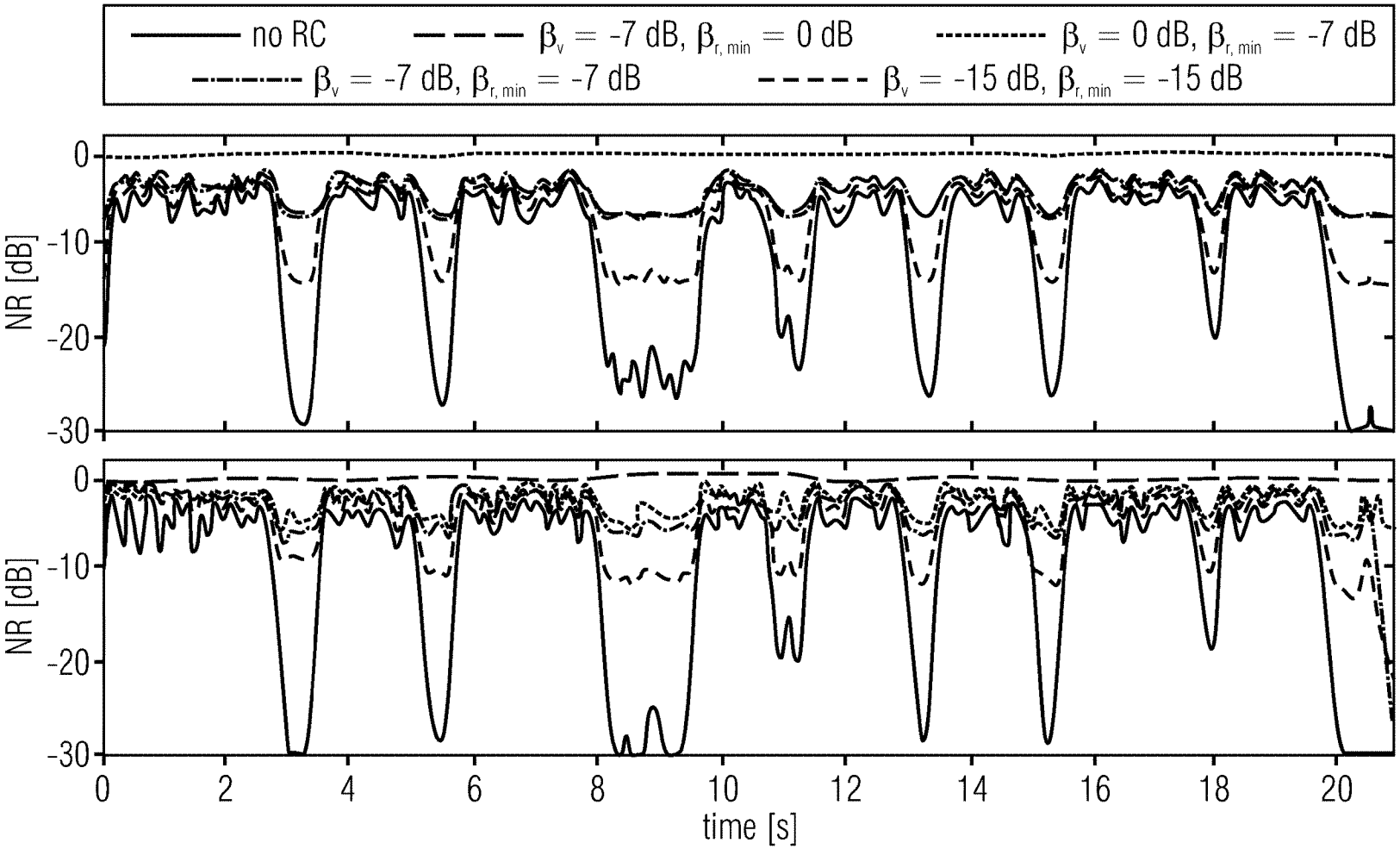
FIG. 13 shows a graphic representation of noise reduction and reverberation reduction for varying control parameters $\beta_v$ and $\beta_{r,\ MIN}$, iSNR=15 dB, M=2, L=12.

In this experiment, we simulated a scenario with a single speaker at a stationary position using measured RIRs in the acoustic lab with $T_{60}$=630 ms. In FIG. 13, five different settings for the attenuation factors are shown: No reduction control ($\beta_v=\beta_{r,min}=0$), a moderate setting with $\beta_v=\beta_{r,min}=-7$ dB, reducing either only reverberation or only noise, and a stronger attenuation setting with $\beta_v=\beta_{r,min}=-15$ dB. We can observe that the noise reduction measure yields the desired reduction levels only during speech pauses. The reverberation reduction measure surprisingly shows that a high reduction is only achieved during speech absence. This does not mean that the residual reverberation is more audible during speech presence, as the direct sound of the speech perceptually masks the residual reverberation. During the first 5 seconds, we can observe the reduced reverberation reduction caused by the adaptive reverberation attenuation factor (45), as the Kalman filter error is high during the initial convergence.

3.6 Conclusion

In the following, some conclusions regarding the embodiments described in this subsection will be provided.

According to the concept of the present invention, as an embodiment, an alternating minimization algorithm based on two interacting Kalman filters was described to estimate multi-channel autoregressive parameters and a reverberant signal to reduce noise and reverberation from each microphone signal (for example, of a multi-channel microphone signal which serves as a input signal). The proposed solution using, for example, recursive Kalman filters is suitable for online processing applications.

The effectiveness and superior performance to similar online methods was shown in various experiments.

In addition, a method and concept to control the reduction of noise and reverberation independently, to mask possible artifacts and to adjust the output signal to perceptual requirements, was described. The method and concept to control the reduction of noise and reverberation can, for example, be used in combination with the concept to estimate multi-channel autoregressive parameters and the reverberant signal (for example, as an optional extension).

3.7. Appendix: Computation of Residual Noise and Reverberation

In the following, some concepts for the computation of residual noise and reverberation will be described which may, for example, be used in the evaluation of the concept according to the present invention. However, optionally, the concepts described here can also be used in embodiments according to the invention in which additional information regarding the processed signals is desired.

Computation of Residual Noise and Reverberation

To compute residual power of noise and reverberation at the output of the proposed system, it is possible to propagate these signals through the system.

By propagating only the noise at the input v(n) through the dual-Kalman system instead of y(n) as in FIG. 7, we obtain the output $\hat{s}_v(n)$, which is the residual noise contained in $\hat{s}(n)$. By also taking the RC into account, the residual contribution of the noise v(n) in the output signal z(n) is $z_v(n)$. By inspecting (32), (34) and (36), the noise is fed through the noise reduction Kalman filter by the equation $$\underline{\tilde{v}}(n) = F(n)\underline{\tilde{v}}(n-1) + K_x(n)[v(n) - HF(n)\underline{\tilde{v}}(n-1)] = K_x(n)v(n) + [F(n) - K_x(n)HF(n)]\underline{\tilde{v}}(n-1), \tag{48}$$

where $\underline{\tilde{v}}(n)$ is the residual noise vector of length ML, similarly defined as (6), after noise reduction. The output after the dereverberation step is obtained by $$\hat{s}_v(n) = \underbrace{H\underline{\tilde{v}}(n)}_{\tilde{v}(n)} - \underbrace{HF(n)\underline{\tilde{v}}(n-1)}_{\tilde{v}(n|n-1)}. \tag{49}$$

With RC, the residual noise is given in analogy to (44) by $$z_v(n)=\beta_v(n)+(1-\beta_v)\tilde{v}(n)-(1-\beta_r)\tilde{v}(n|n-1). \tag{50}$$

The calculation of the residual reverberation $z_r(n)$ is more difficult. To exclude the noise from this calculation, we first feed the oracle reverberant noise-free signal vector x(n) through the noise reduction stage:

$$\underline{\tilde{x}}(n) = F(n)\underline{\tilde{x}}(n-1) + K_x(n)[x(n) - HF(n)\underline{\tilde{x}}(n-1)] = K_x(n)x(n) + [F(n) - K_x(n)HF(n)]\underline{\tilde{x}}(n-1), \tag{51}$$

where $\tilde{x}(n)=H\underline{\tilde{x}}(n)$ is the output of the noise-free signal vector x(n) after the noise reduction stage. According to (44) the output of the noise-free signal vector after dereverberation and RC is obtained by $$z_x(n)=\beta_r x(n)+(1-\beta_v)\tilde{x}(n)-(1-\beta_r)\tilde{r}(n) \tag{52}$$

where $\tilde{r}(n)=\tilde{X}(n-D)\hat{c}(n)$ and the matrix $\tilde{X}(n)$ is obtained using $\tilde{x}(n)$ in analogy to (3).

Now let us assume that the noise-free signal vector after the noise reduction $\tilde{x}(n)$ and the noise-free output signal vector after dereverberation and RC $z_x(n)$ are composed as $$\tilde{x}(n)\approx s(n)+r(n) \tag{53}$$

$$z_x(n)\approx s(n)+z_r(n), \tag{54}$$

where $z_r(n)$ denotes the residual reverberation in the RC output z(n). By using (53) and knowledge of the oracle desired signal vector s(n), we can compute the reverberation signal $$r(n)=\tilde{x}(n)-s(n). \tag{55}$$

From the difference of (53) and (54) and using (55), we can obtain the residual reverberation signals as $$z_r(n) = r(n) - \underbrace{[\tilde{x}(n) - z_x(n)]}_{r(n)-z_r(n)}. \tag{56}$$

Now we can analyze the power of residual noise and/or reverberation at the output and compare it to their respective power at the input.

4. Conclusions

In the following, some conclusions will be provided.

Embodiments according to the invention can optionally comprise one or more of the following features:

- Receiving at least one microphone signal, or, alternatively, receiving at least two microphone signals (optional).
- Transforming the microphone signal or the microphone signals into the time-frequency domain or another suitable domain (optional).
- Estimating the noise covariance matrix (optional).
- Using a parallel estimation structure for joint estimation of MAR coefficients and noise-free reverberant signal.

The MAR coefficients are estimated using the noisy reverberant input signals and delayed estimated reverberant output signals from the noise reduction stage.

The noise reduction stage receives current MAR coefficient estimates in each frame (optional).

Computing the output signal (or, alternatively, output signals) by filtering the noise-free reverberant signal (or, alternatively, noise-free reverberant signals) (optional).

Computing a controlled output signal (or, alternatively, output signals) from the estimated signal components to set the amount of residual noise and reverberation (optional).

Optionally computing a modified output signal (or, alternately, output signals) by adding one or more processed/shaped reverberation signals with a certain level to the estimated dereverberated signal (or, alternately, estimated dereverberated signals) to achieve a different reverberation characteristic at the output signal.

To further conclude, in the present description, different inventive embodiments and aspects have been described in a chapter "Method and Apparatus for Dereverberation and Noise Reduction (using a parallel structure) With Reduction Control" (Section 2) and in a chapter "Linear Prediction Based Online Dereverberation and Noise Reduction Using Alternating Kalman Filters" (Section 3).

Also, further embodiments are defined by the enclosed claims and in the other sections (e.g. in the section "Summary of the invention" and in Section 1.)

It should be noted that any embodiment as defined by the claims can be supplemented by any of the details (for example, features and functionalities) described herein. Also, the embodiments described in the above mentioned sections can be used individually and can also be supplemented by any of the features in another section or by any feature included in the claims.

Also, it should be noted that the individual aspects described herein can be used individually or in combination. Thus, details can be added to each of said individual aspects without adding details to another of the aspects.

It should also be noted that the present disclosure describes, explicitly or implicitly, features usable in an audio encoder (apparatus for providing an encoded representation of an input audio signal) and in an audio decoder (apparatus for providing a decoded representation of an audio signal on the basis of an encoded representation). Thus, any of the features described herein can be used in the context of an audio encoder and in the context of an audio decoder.

Moreover, features and functionalities disclosed herein relating to a method can also be used in an apparatus (configured to perform such a method or functionality). Furthermore, any of the features and functionalities disclosed herein with respect to an apparatus can also be used in a corresponding method. In other words, the methods disclosed herein can be supplemented by any of the features and functionalities described with respect to the apparatuses and vice versa. Also, any of the features and functionalities described herein can be implemented in hardware and software (or using hardware and/or software), or even a combination of hardware and software, as will be described in the section "Implementation Alternatives".

Also, it should be noted that the processing described herein may be performed, for example (but not necessarily) per frequency band or per frequency bin or for different frequency regions.

It should be noted that aspects of the invention relate to a method and apparatus for online dereverberation and noise reduction with reduction control.

Embodiments according to the invention create a novel parallel structure for joint dereverberation and noise reduction. The reverberant signal is modelled, for example, using a narrowband multichannel autoregressive reverberation model with time-varying coefficients, which account for non-stationary acoustic environments. In contrast to existing sequential estimation structures, embodiments according to the invention estimate the noise-free reverberant signal and the autoregressive room coefficients in parallel, such that assumptions on stationary room coefficients are not required. In addition, a method to independently control the reduction level of noise and reverberation is proposed.

5. Method According to FIG. 14

Figure 14:
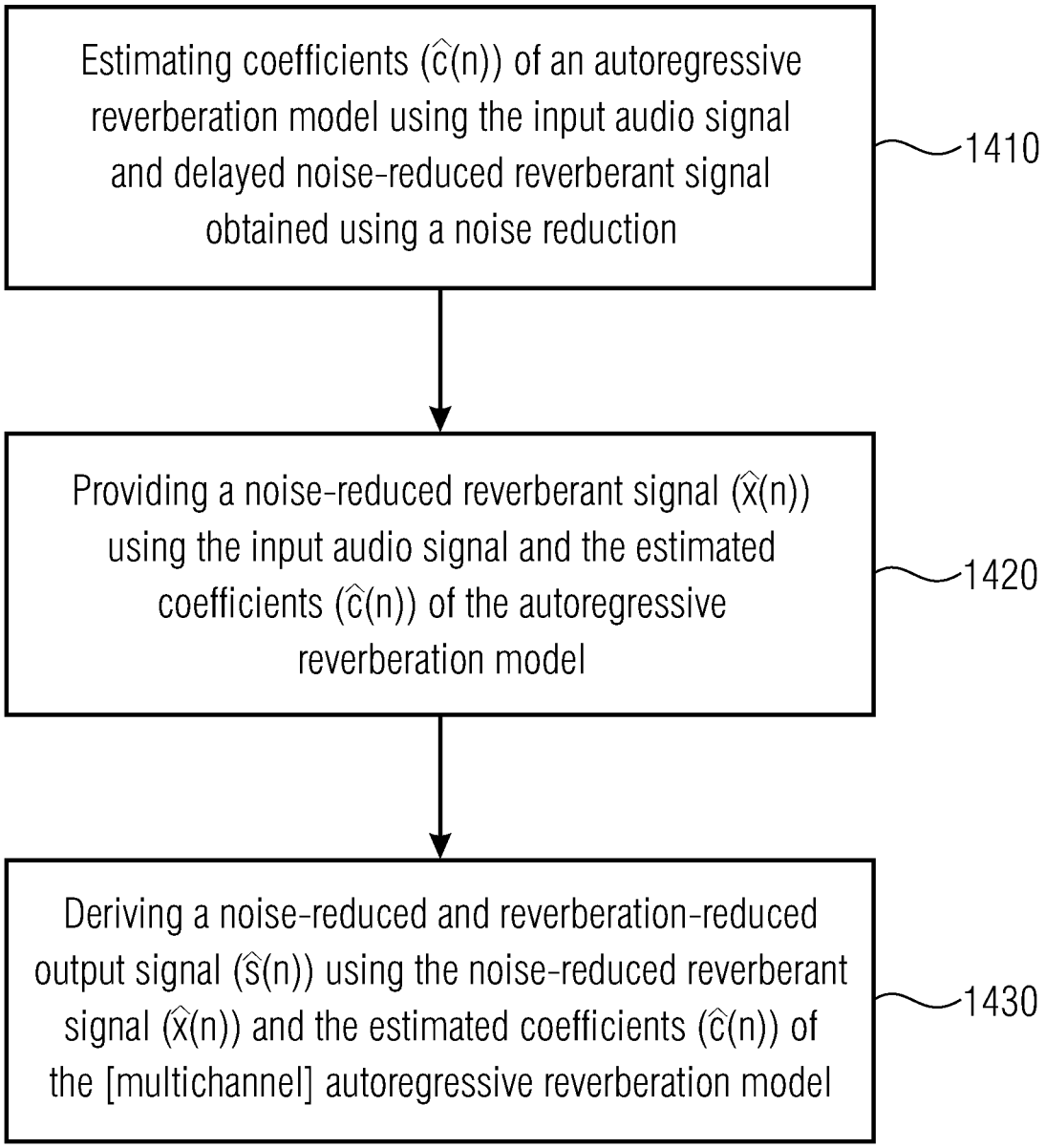
FIG. 14 shows a flow chart of a method for providing a processed audio signal on the basis of an input audio signal, according to an embodiment of the present invention.

FIG. 14 shows a flow chart of a method 1400 according to an embodiment of the present invention.

The method 1400 for providing a processed audio signal on the basis of an input audio signal comprises estimating 1410 coefficients of an autoregressive reverberation model using the input audio signal and a delayed noise-reduced reverberant signal obtained using a noise reduction stage.

The method also comprises providing 1420 a noise-reduced reverberant signal using the input audio signal and the estimated coefficients of the autoregressive reverberation model.

The method also comprises deriving 1430 a noise-reduced and reverberation-reduced output signal using the noise-reduced reverberant signal and the estimated coefficients of the autoregressive reverberation model.

The method 1400 can optionally be supplemented by any of the features, functionalities and details describer herein, both individually and in combination.

6. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The apparatus described herein may be implemented using a hardware apparatus, or using a computer, or using a combination of a hardware apparatus and a computer.

The apparatus described herein, or any components of the apparatus described herein, may be implemented at least partially in hardware and/or in software.

The methods described herein may be performed using a hardware apparatus, or using a computer, or using a combination of a hardware apparatus and a computer.

The methods described herein, or any components of the apparatus described herein, may be performed at least partially by hardware and/or by software.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[Yoshioka2009] T. Yoshioka, T. Nakatani, and M. Miyoshi, "Integrated speech enhancement method using noise suppression and dereverberation," *IEEE Trans. Audio, Speech, Lang. Process.*, vol. 17, no. 2, pp. 231-246, February 2009.

[Togami2013] M. Togami and Y. Kawaguchi, "Noise robust speech dereverberation with Kalman smoother," in *Proc. IEEE Intl. Conf. on Acoustics, Speech and Signal Processing* (*ICASSP*), May 2013, pp. 7447-7451.

[Yoshioka2013] T. Yoshioka and T. Nakatani, "Dereverberation for reverberation-robust microphone arrays," in *Proc. European Signal Processing Conf.* (*EUSIPCO*), September 2013, pp. 1-5.

[Togami2015] M. Togami, "Multichannel online speech dereverberation under noisy environments," in *Proc. European Signal Processing Conf.* (*EUSIPCO*), Nice, France, September 2015, pp. 1078-1082.

[Yoshioka2012] T. Yoshioka and T. Nakatani, "Generalization of multi-channel linear prediction methods for blind MIMO impulse response shortening," *IEEE Trans. Audio, Speech, Lang. Process.*, vol. 20, no. 10, pp. 2707-2720, December 2012.

[Nakatani2010] T. Nakatani, T. Yoshioka, K. Kinoshita, M. Miyoshi, and J. Biing-Hwang, "Speech dereverberation based on variance-normalized delayed linear prediction," *IEEE Trans. Audio, Speech, Lang. Process.*, vol. 18, no. 7, pp. 1717-1731, 2010.

[Jukic2016] A. Jukic, Z. Wang, T. van Waterschoot, T. Gerkmann, and S. Doclo, "Constrained multi-channel linear prediction for adaptive speech dereverberation," in *Proc. Intl. Workshop Acoust Signal Enhancement* (*IWAENC*), Xi'an, China, September 2016.

[Braun2016] S. Braun and E. A. P. Habets, "Online dereverberation for dynamic scenarios using a Kalman filter with an autoregressive models," *IEEE Signal Process. Lett.*, vol. 23, no. 12, pp. 1741-1745, December 2016.

[Gerkmann2012] T. Gerkmann and R. C. Hendriks, "Unbiased MMSE-based noise power estimation with low complexity and low tracking delay," *IEEE Trans. Audio, Speech, Lang. Process.*, vol. 20, no. 4, pp. 1383-1393, May 2012.

[Taseska2012] M. Taseska and E. A. P. Habets, "MMSE-based blind source extraction in diffuse noise fields using a complex coherence-based SAP estimator," in *Proc. Intl. Workshop Acoust. Signal Enhancement* (*IWAENC*), Aachen, Germany, September 2012.

[1] J. B. Allen and D. A. Berkley, "Image method for efficiently simulating small-room acoustics," *J. Acoust. Soc. Am.*, vol. 65, no. 4, pp. 943-950, April 1979.

[2] S. Braun and E. A. P. Habets, "A multichannel diffuse power estimator for dereverberation in the presence of multiple sources," *EURASIP Journal on Audio, Speech, and Music Processing*, vol. 2015, no. 1, pp. 1-14, 2015.

[3] S. Braun and E. A. P. Habets, "Online dereverberation for dynamic scenarios using a Kalman filter with an autoregressive models," *IEEE Signal Process. Lett.*, vol. 23, no. 12, pp. 1741-1745, December 2016.

[4] T. Dietzen, A. Spriet, W. Tirry, S. Doclo, M. Moonen, and T. van Waterschoot, "Partitioned block frequency domain Kalman filter for multi-channel linear prediction based blind speech dereverberation," in *Proc. Intl. Workshop Acoust. Signal Enhancement* (*IWAENC*), Xi'an, China, September 2016.

[5] E. B. Union. (1988) Sound quality assessment material recordings for subjective tests. [Online]. Available: http://tech.ebu.ch/publications/sqamcd

[6] G. Enzner and P. Vary, "Frequency-domain adaptive Kalman filter for acoustic echo control in hands-free telephones," *Signal Processing*, vol. 86, no. 6, pp. 1140-1156, 2006.

[7] Y. Ephraim and D. Malah, "Speech enhancement using a minimum-mean square error short-time spectral amplitude estimator," *IEEE Trans. Acoust., Speech, Signal Process.*, vol. 32, no. 6, pp. 1109-1121, December 1984.

[8] S. Gannot, D. Burshtein, and E. Weinstein, "Iterative and sequential Kalman filter-based speech enhancement algorithms," *IEEE Trans. Speech Audio Process.*, vol. 6, no. 4, pp. 373-385, July 1998.

[9] T. Gerkmann and R. C. Hendriks, "Unbiased MMSE-based noise power estimation with low complexity and low tracking delay," *IEEE Trans. Audio, Speech, Lang. Process.*, vol. 20, no. 4, pp. 1383-1393, May 2012.

[10] S. Goetze, A. Warzybok, I. Kodrasi, J. O. Jungmann, B. Cauchi, J. Rennies, E. A. P. Habets, A. Mertins, T. Gerkmann, S. Doclo, and B. Kollmeier, "A study on speech quality and speech intelligibility measures for quality assessment of single-channel dereverberation algorithms," in *Proc. Intl. Workshop Acoust. Signal Enhancement* (*IWAENC*), September 2014, pp. 233-237.

[11] ITU-T, *Perceptual evaluation of speech quality* (*PESQ*), *an objective method for end-to-end speech quality assessment of narrowband telephone networks and speech codecs*, International Telecommunications Union (ITU-T) Recommendation P.862, February 2001.

[12] A. Jukic, Z. Wang, T. van Waterschoot, T. Gerkmann, and S. Doclo, "Constrained multi-channel linear prediction for adaptive speech dereverberation," in *Proc. Intl. Workshop Acoust. Signal Enhancement* (*IWAENC*), Xi'an, China, September 2016.

[13] A. Jukic, T. van Waterschoot, and S. Doclo, "Adaptive speech dereverberation using constrained sparse multichannel linear prediction," *IEEE Signal Process. Lett.*, vol. 24, no. 1, pp. 101-105, January 2017.

[14] R. E. Kalman, "A new approach to linear filtering and prediction problems," *Trans. of the ASME Journal of Basic Engineering*, vol. 82, no. Series D, pp. 35-45, 1960.

[15] K. Kinoshita, M. Delcroix, S. Gannot, E. A. P. Habets, R. Haeb-Umbach, W. Kellermann, V. Leutnant, R. Maas, T. Nakatani, B. Raj, A. Sehr, and T. Yoshioka, "A summary of the REVERB challenge: state-of-the-art and remaining challenges in reverberant speech processing research," *EURASIP Journal on Advances in Signal Processing*, vol. 2016, no. 1, p. 7, January 2016.

[16] N. Kitawaki, H. Nagabuchi, and K. Itoh, "Objective quality evaluation for low bit-rate speech coding systems," *IEEE J. Sel. Areas Commun.*, vol. 6, no. 2, pp. 262-273, 1988.

[17] D. Labarre, E. Grivel, Y. Berthoumieu, E. Todini, and M. Najim, "Consistent estimation of autoregressive parameters from noisy observations based on two interacting Kalman filters," *Signal Processing*, vol. 86, no. 10, pp. 2863-2876, 2006, special Section: Fractional Calculus Applications in Signals and Systems.

[18] P. C. Loizou, *Speech Enhancement Theory and Practice*. 1 em plus 0.5 em minus 0.4 em Taylor & Francis, 2007.

[19] R. Martin, "Noise power spectral density estimation based on optimal smoothing and minimum statistics," *IEEE Trans. Speech Audio Process.*, vol. 9, pp. 504-512, July 2001.

[20] M. Miyoshi and Y. Kaneda, "Inverse filtering of room acoustics," *IEEE Trans. Acoust., Speech, Signal Process.*, vol. 36, no. 2, pp. 145-152, February 1988.

[21] T. Nakatani, T. Yoshioka, K. Kinoshita, M. Miyoshi, and J. Biing-Hwang, "Speech dereverberation based on variance-normalized delayed linear prediction," *IEEE Trans. Audio, Speech, Lang. Process.*, vol. 18, no. 7, pp. 1717-1731, 2010.

[22] P. A. Naylor and N. D. Gaubitch, Eds., *Speech Dereverberation*. 1 em plus 0.5 em minus 0.4 em London, UK: Springer, 2010.

[23] U. Niesen, D. Shah, and G. W. Wornell, "Adaptive alternating minimization algorithms," *IEEE Transactions on Information Theory*, vol. 55, no. 3, pp. 1423-1429, March 2009.

[24] J. F. Santos, M. Senoussaoui, and T. H. Falk, "An updated objective intelligibility estimation metric for normal hearing listeners under noise and reverberation," in *Proc. Intl. Workshop Acoust. Signal Enhancement* (*IWAENC*), Antibes, France, September 2014.

[25] D. Schmid, G. Enzner, S. Malik, D. Kolossa, and R. Martin, "Variational Bayesian inference for multichannel dereverberation and noise reduction," *IEEE Trans. Audio, Speech, Lang. Process.*, vol. 22, no. 8, pp. 1320-1335, August 2014.

[26] B. Schwartz, S. Gannot, and E. Habets, "Online speech dereverberation using Kalman filter and EM algorithm," *IEEE Trans. Audio, Speech, Lang. Process.*, vol. 23, no. 2, pp. 394-406, 2015.

[27] O. Schwartz, S. Gannot, and E. Habets, "Multi-microphone speech dereverberation and noise reduction using relative early transfer functions," *IEEE Trans. Audio, Speech, Lang. Process.*, vol. 23, no. 2, pp. 240-251, January 2015.

[28] M. Taseska and E. A. P. Habets, "MMSE-based blind source extraction in diffuse noise fields using a complex coherence-based a priori SAP estimator," in *Proc. Intl. Workshop Acoust. Signal Enhancement* (*IWAENC*), September 2012.

[29] M. Togami, Y. Kawaguchi, R. Takeda, Y. Obuchi, and N. Nukaga, "Optimized speech dereverberation from probabilistic perspective for time varying acoustic transfer function," *IEEE Trans. Audio, Speech, Lang. Process.*, vol. 21, no. 7, pp. 1369-1380, July 2013.

[30] M. Togami and Y. Kawaguchi, "Noise robust speech dereverberation with Kalman smoother," in *Proc. IEEE Intl. Conf. on Acoustics, Speech and Signal Processing* (*ICASSP*), May 2013, pp. 7447-7451.

[31] M. Togami, "Multichannel online speech dereverberation under noisy environments," in *Proc. European Signal Processing Conf.* (*EUSIPCO*), Nice, France, September 2015, pp. 1078-1082.

[32] T. Yoshioka, T. Nakatani, and M. Miyoshi, "Integrated speech enhancement method using noise suppression and dereverberation," *IEEE Trans. Audio, Speech, Lang. Process.*, vol. 17, no. 2, pp. 231-246, February 2009.

[33] T. Yoshioka and T. Nakatani, "Generalization of multichannel linear prediction methods for blind MIMO impulse response shortening," *IEEE Trans. Audio, Speech, Lang. Process.*, vol. 20, no. 10, pp. 2707-2720, December 2012.

[34] T. Yoshioka, A. Sehr, M. Delcroix, K. Kinoshita, R. Maas, T. Nakatani, and W. Kellermann, "Making machines understand us in reverberant rooms: Robustness against reverberation for automatic speech recognition," *IEEE Signal Processing Magazine*, vol. 29, no. 6, pp. 114-126, November 2012.

[35] T. Yoshioka and T. Nakatani, "Dereverberation for reverberation-robust microphone arrays," in *Proc. European Signal Processing Conf.* (*EUSIPCO*), September 2013, pp. 1-5.

[36] [Online]. Available: http://www.audiolabs-erlangen.de/fau/professor/habets/software/signal-generator

The invention claimed is:

1. A signal processor for providing one or more processed audio signals on the basis of one or more input audio signals, wherein the signal processor is configured to estimate coefficients of an autoregressive reverberation model using the one or more input audio signals and one or more delayed noise-reduced reverberant signals acquired using a noise reduction; and wherein the signal processor is configured to provide one or more noise-reduced reverberant signals using the input audio signal and the estimated coefficients of the autoregressive reverberation model; and wherein the signal processor is configured to derive one or more noise-reduced and reverberation-reduced output signals using the one or more noise-reduced reverberant signals and the estimated coefficients of the autoregressive reverberation model.

2. The signal processor according to claim 1, wherein the signal processor is configured to estimate coefficients of a multichannel autoregressive reverberation model.

3. The signal processor according to claim 1, wherein the signal processor is configured to use estimated coefficients of the autoregressive reverberation model associated with a currently processed portion of the input audio signal in order to provide the noise-reduced reverberant signal associated with the currently processed portion of the input audio signal.

4. The signal processor according to claim 1, wherein the signal processor is configured to use one or more delayed noise-reduced reverberant signals associated with a previously processed portion of the input audio signal for an estimation of coefficients of the autoregressive reverberation model associated with a currently processed portion of the input audio signal.

5. The signal processor according to claim 1, wherein the signal processor is configured to alternatingly provide estimated coefficients of the autoregressive reverberation model and noise-reduced reverberant signal portions, and wherein the signal processor is configured to use estimated coefficients of the autoregressive reverberation model for the provision of the noise-reduced reverberant signal portions, and wherein the signal processor is configured to use one or more delayed noise-reduced reverberant signals for the estimation of coefficients of the multichannel autoregressive reverberation model.

6. The signal processor according to claim 1, wherein the signal processor is configured to apply an algorithm which minimizes a cost function in order to estimate the coefficients of the autoregressive reverberation model.

7. The signal processor according to claim 6, wherein the cost function used for the estimation of the coefficients of the autoregressive reverberation model is an expectation value for a mean squared error of the coefficients of the autoregressive reverberation model.

8. The signal processor according to claim 6, wherein the signal processor is configured to apply the algorithm for the minimization of the cost function in order to estimate the coefficients of the autoregressive reverberation model under the assumption that the noise-reduced reverberant signal is fixed.

9. The signal processor according to claim 1, wherein the signal processor is configured to apply an algorithm for a minimization of a cost function in order to estimate the noise-reduced reverberant signal.

10. The signal processor according to claim 9, wherein the cost function used for the estimation of the reverberant signal is an expectation value for a mean squared error of the reverberant signal.

11. The signal processor according to claim 9, wherein the signal processor is configured to apply the algorithm for the minimization of the cost function in order to estimate the reverberant signal under the assumption that the coefficients of the autoregressive reverberation model are fixed.

12. The signal processor according to claim 1, wherein the signal processor is configured to determine a reverberation component on the basis of estimated coefficients of the autoregressive reverberation model and on the basis of one or more delayed noise-reduced reverberant signals associated with a previously processed portion of the input audio signal, and wherein the signal processor is configured to cancel the reverberation component from the noise-reduced reverberant signal associated with a currently processed portion of the input audio signal, in order to acquire the noise-reduced and reverberation-reduced output signal.

13. The signal processor according to claim 1, wherein the signal processor is configured to perform a weighted combination of the input audio signal and of the noise-reduced reverberant signal and of a reverberation component, in order to acquire the noise-reduced and reverberation-reduced output signal.

14. The signal processor according to claim 13, wherein the signal processor is configured to also comprise a shaped version of the reverberation component in the weighted combination.

15. The signal processor according to claim 1, wherein the signal processor is configured to estimate a statistic of a noise component of the input audio signal.

16. The signal processor according to claim 1, wherein the signal processor is configured to estimate a statistic of a noise component of the input audio signal during a non-speech period.

17. The signal processor according to claim 1, wherein the signal processor is configured to estimate the coefficients of the autoregressive reverberation model using a Kalman filter.

18. The signal processor according to claim 1, wherein the signal processor is configured to estimate the coefficients of the autoregressive reverberation model on the basis of an estimated error matrix of a vector of coefficients of the autoregressive reverberation model;

an estimated covariance of an uncertainty noise of the vector of coefficients of the autoregressive reverberation model;

a previous vector of coefficients of the autoregressive reverberation model;

one or more delayed noise-reduced reverberant signals;

an estimated covariance associated with noisy but reverberation reduced signal components of the input audio signal;

the input audio signal.

19. The signal processor according to claim 1, wherein the signal processor is configured to estimate the noise-reduced reverberant signal using a Kalman filter.

20. The signal processor according to claim 1, wherein the signal processor is configured to estimate the noise-reduced reverberant signal on the basis of an estimated error matrix of the noise-reduced reverberant signal;

an estimated covariance of a desired speech signal;

one or more previous estimates of the noise-reduced reverberant signal;

a plurality of coefficients of the autoregressive reverberation model;

an estimated noise covariance associated with the input audio signal; and the input audio signal.

21. The signal processor according to claim 1, wherein the signal processor is configured to acquire an estimated covariance associated with noisy but reverberation-reduced signal components of the input audio signal on the basis of a weighted combination;

of a recursive covariance estimate determined recursively using previous estimates of noisy but reverberation-reduced signal components of the input audio signal; and of an outer product of an estimate of noisy but reverberation-reduced signal components of the input audio signal.

22. The signal processor according to claim 21, wherein the recursive covariance estimate is based on an estimation of the noisy but reverberation-reduced signal components of the input audio signal computed using final estimate coefficients of the autoregressive reverberation model and using a final estimate of the noise-reduced reverberant signal; and/or wherein the signal processor is configured to acquire the outer product of the noisy but reverberation-reduced signal components of the input audio signal on the basis of an intermediate estimate of the coefficients of the autoregressive reverberation model.

23. The signal processor according to claim 1, wherein the signal processor is configured to acquire an estimated covariance associated with a noise-reduced and reverberation-reduced signal component of the input audio signal on the basis of a weighted combination of a recursive covariance estimate determined recursively using previous estimates of noise-reduced and reverberation-reduced signal components of the input audio signal; and of an a-priori estimate of the covariance which is based on a currently processed portion of the input audio signal.

24. The signal processor according to claim 23, wherein the signal processor is configured to acquire the recursive covariance estimate based on an estimation of the noise-reduced and reverberation-reduced signal components of the input audio signal computed using final estimated coefficients of the autoregressive reverberation model and using a final estimate of the noise-reduced reverberant output signal; and/or wherein the signal processor is configured to acquire the a-priori estimate of the covariance using a Wiener filtering of the input audio signal, wherein a Wiener filtering operation is determined in dependence on covariance information regarding the input audio signal, in dependence on covariance information regarding a reverberation component of the input audio signal, and in dependence on covariance information regarding a noise component of the input audio signal.

25. A method for providing one or more processed audio signals on the basis of one or more input audio signals, wherein the method comprises estimating coefficients of an autoregressive reverberation model using the one or more input audio signals and one or more delayed noise-reduced reverberant signals acquired using a noise reduction; and wherein the method comprises providing one or more noise-reduced reverberant signals using the one or more input audio signals and the estimated coefficients of the autoregressive reverberation model; and wherein the method comprises deriving one or more noise-reduced and reverberation-reduced output signals using the one or more noise-reduced reverberant signals and the estimated coefficients of the autoregressive reverberation model.

26. A non-transitory digital storage medium having a computer program stored thereon to perform the method for providing one or more processed audio signals on the basis of one or more input audio signals, wherein the method comprises estimating coefficients of an autoregressive reverberation model using the one or more input audio signals and one or more delayed noise-reduced reverberant signals acquired using a noise reduction; and wherein the method comprises providing one or more noise-reduced reverberant signals using the one or more input audio signals and the estimated coefficients of the autoregressive reverberation model; and wherein the method comprises deriving one or more noise-reduced and reverberation-reduced output signals using the one or more noise-reduced reverberant signals and the estimated coefficients of the autoregressive reverberation model, when said computer program is run by a computer.

* * * * *